US006776743B2

(12) United States Patent
Hur

(10) Patent No.: US 6,776,743 B2
(45) Date of Patent: Aug. 17, 2004

(54) WAIST STRENGTHENING AND REHABILITATING APPARATUS AND LOAD CONTROLLER THEREFOR

(76) Inventor: Young Baeg Hur, 102-1201 Hyundai, 4, Oksu-dong, Sungdong-ku, Seoul 133-100 (KR)

( * ) Notice: Subject to any disclaimer, the term of this patent is extended or adjusted under 35 U.S.C. 154(b) by 0 days.

(21) Appl. No.: 10/040,756

(22) Filed: Dec. 29, 2001

(65) Prior Publication Data

US 2002/0111257 A1 Aug. 15, 2002

(30) Foreign Application Priority Data

Feb. 9, 2001 (KR) ..... 2001-6435

(51) Int. Cl.[7] ..... A63B 26/00

(52) U.S. Cl. ..... 482/140; 482/142; 482/148; 482/907

(58) Field of Search ..... 482/140, 907, 482/142, 148

(56) References Cited

U.S. PATENT DOCUMENTS 4,200,279 A * 4/1980 Lambert ..... 272/118
4,240,626 A 12/1980 Lambert, Jr.
4,500,089 A 2/1985 Jones
5,549,534 A 8/1996 Parviainen
6,015,372 A 1/2000 Steffee et al.

FOREIGN PATENT DOCUMENTS

EP 0801213 * 10/1997

* cited by examiner

*Primary Examiner*—Nicholas D. Lucchesi
*Assistant Examiner*—L Amerson
(74) *Attorney, Agent, or Firm*—Patton Boggs LLP

(57) ABSTRACT

A support unit is constructed by assembling all or some of a footrest, a backrest, a pedestal, a handle, and related frames. Waist exercises are conducted utilizing a backrest frame operated in conjunction with a load controller, with the lower part of the user's body being fixed to the support unit. An apparatus further comprises a lower body holder mounted on the support unit. The lower body holder preferably comprises a front thigh holder for tightly holding the front potion of a thigh, a rear thigh holder for tightly holding the rear portion of a thigh, a front pelvis holder for tightly holding the front portion of a pelvis, and a rear pelvis holder for tightly holding the rear portion of a pelvis.

6 Claims, 18 Drawing Sheets

WAIST STRENGTHENING AND REHABILITATING APPARATUS AND LOAD CONTROLLER THEREFOR

BACKGROUND OF THE INVENTION

1. Field of the Invention

The present invention relates generally to waist strengthening and rehabilitating apparatuses for strengthening and rehabilitating the waist including the lumbar vertebrae and the lumbar muscles, and more particularly to a waist strengthening and rehabilitating apparatus and load controller used in conjunction with the apparatus to produce desired load by controlling the flow direction and amount of working fluid.

2. Description of the Prior Art

Generally, around the waist region, the pelvis is connected to the vertebrae and two hip joints are connected to the pelvis. Various lumbar muscles are connected to both pelvis and vertebrae, so that the pelvis can conduct movement relative to the vertebrae.

U.S. Pat. No. 5,928,112 discloses one of conventional waist strengthening and rehabilitating apparatuses that are used to strengthen or rehabilitate the waist.

However, the conventional waist strengthening and rehabilitating apparatus has a problem in a user's performing bending exercises in which the user sits up upright from a position where the waist is bent while the lower part of his body is firmly held by a thigh holding belt, as described below.

As shown in FIG. 1, the lower part of the body including the pelvis 1 is tightly held by the conventional apparatus in such a way that the knee 4 is raised up by a footrest 10 pushing the feet and the center portion of the thigh 3 is tied around a seat plate 12 by a belt 11 to bring the pelvis 1 into contact with the seat plate 12. However, in accordance with the conventional apparatus, only the femur 7 is tightly held by the belt 11, while the pelvis 1 is movable forward and rearward.

In more detail, in the conventional waist strengthening and rehabilitating apparatus, the knee 4 is raised up by elevating the footrest 10 from a position where the rear portion of the pelvis 1 is supported by a pelvis support 13, the feet 6 rest on the footrest 10 and a knee support 14 is situated at a proper height. As a result, the knee 4 is brought into contact with the knee support 14, but the lower portion of the thigh 3 becomes spaced apart from the seat plate 12. In this state, the center portion of the thigh 3 is tightly tied by the wide belt 11 to bring the pelvis 1 into contact with the seat plate 12.

When the center portion of the thigh is downwardly pushed by the belt 11, the waist seems to be tightly held by the conventional strengthening and rehabilitating apparatus, since the pelvis 1 is brought into contact with the seat plate 1 and the rear portion of the pelvis 1 is supported by the pelvis support 13. However, only the femur 7 is tightly held by the belt 11 and the pelvis 1 is movable forward and rearward, so that the pelvis 1 can be rotated around the hip joint 2, thus causing the lower part of the body to be somewhat freely movable.

Additionally, the rear portion of the pelvis 1 seems to be supported by the pelvis support 13, but shock absorbing space exists between the rear portion of the pelvis 1 and the pelvis support 13. Accordingly, this cannot be called a safe holding from the medical point of view.

When the center portion of the thigh 3 is tightly held by the belt 11 with the knee raised up by the footrest 10 pushing the feet 6, the pelvis 1 is brought into tight contact with the seat plate 12, but space is created between the thigh 3 and the seat plate 12. The space allows the thigh 3 to be moved, so that the thigh 3 is not tightly held by the apparatus.

In practice, when a user performs bending exercises in which he sits up straight from a position where the waist is bent, force resulting from the bending exercises is transmitted to feet through the pelvis 1, the femur 7 and the calf 5. The force exerted on the footrest 10 is increased in proportion to the force applied by a user. The sequential transmission of the reaction proceeding from the pelvis 1 to the feet 6 means that the bones and joints ranging from the pelvis 1 to the feet 6 are not properly held by the apparatus.

Though the waist seems to be tightly held by the conventional waist strengthening and rehabilitating apparatus because feet are laid on the footrest 10 and the buttocks is supported by the pelvis support 13, shock absorbing space exists between the pelvis 1 and the pelvis support 13. Consequently, the pelvis 1 should be moved rearward till the pelvis 1 is brought into tight contact with the pelvis support 13, and the belt is tightened correspondingly.

The belt 11 is tightened to the center portion of the thigh 3. As a result, it is difficult for the pelvis 1 to be brought into contact with the seat plate 12 and a user may experience pain in his thigh caused by the tightening of the belt 11 so as to bring the pelvis 1 into the seat plate 12.

When a user performs bending exercises in which he sits up straight from a position where the waist is bent, force exerted on the footrest 10 and the tightness of the belt 11 are increased in proportion to force applied by the user. These prove that the waist is not held properly.

The holding of the lower part of the body should be performed so as to suppress the movement of the lower part, since force resulting from the bending exercises of the upper part of the body is exerted to the lower part, causing the lower part to move. However, the conventional waist strengthening and rehabilitating apparatus does not prevent the lower part from moving due to force resulting from the bending exercises of the upper part.

The lumbar vertebrae constituting the principal element of the waist consists of a plurality of vertebrae directly connected to one another without the aid of an additional support bone, and spinal nerves pass through the lumbar vertebrae, so that the lower part of the body including the pelvis should be tightly held during waist exercises. However, in the conventional waist strengthening and rehabilitating apparatus, the knees are held by a holding plate and the center portion of the thighs are tied to a seat by a belt, so that strengthening or rehabilitating effect is poor and accidents such as the fracture of a bone may occur in the case of the elderly and osteoporosis sufferers.

In addition, the conventional waist strengthening and rehabilitating apparatus has shortcomings in that it is difficult for a user to recognize the degree of tightness of the thigh holding belt and the thigh holding belt cannot be rapidly loosened in case of excessive tightening. When pain is excessive during strengthening or rehabilitation or preparation therefor, the thigh holding belt is not easily loosened, thereby causing a problem in safety.

SUMMARY OF THE INVENTION

Accordingly, the present invention has been made keeping in mind the above problems occurring in the prior art, and an object of the present invention is to provide a waist strengthening and rehabilitating apparatus, which is capable of securely holding the lower part of the body, including the pelvis, by means of lower body holding means, momentarily loosening the lower part in an emergency and preventing accidents that may occur during excise.

Another object of the present invention is to provide a waist strengthening and rehabilitating apparatus, which allows waist strengthening and rehabilitating exercise to be actively or passively conducted within a predetermined angle and allows a user to conduct bending, reflexion and twisting exercises.

A further object of the present invention is to provide a load controller, which is capable of easily controlling the quantity and direction of load, being simply constructed, being widely used, and being easily installed and utilized.

In order to accomplish the above object, the present invention provides a waist strengthening and rehabilitating apparatus, in which a support unit is constructed by assembling all or some of a footrest, a backrest, a pedestal, a handle and related frames, and waist exercises are conducted utilizing a backrest frame operated in conjunction with a load controller with the lower part of his body being fixed to the support unit, the apparatus further comprising lower body holding means mounted on the support unit, the lower body holding means being comprised of a front thigh holder for tightly holding the front portion of the thigh and a rear thigh holder for tightly holding the rear portion of the thigh.

The lower body holding means may further comprise pelvis holding means, the pelvis holding means consisting of a front pelvis holder for tightly holding the front portion of the pelvis and a rear pelvis holder for tightly holding the rear portion of the pelvis, or may be constructed by all or some of the front thigh holder, the rear thigh holder, the front pelvis holder and the rear pelvis holder.

The front thigh holder and the rear thigh holder may be each provided with an inclination support unit.

The front thigh holder may comprise moving means in which a pressurizing bar is guided by two pairs of moving links supported by fixed frames; inclined link supporting means provided with an elastic support that supports one inclined moving link; stopper means for preventing the moving link from being moved rearward and allowing the moving link to support the pressurizing bar; and pressurizing means for allowing a pressurizing rod to be pressurized by moving forward the moving link.

The waist strengthening and rehabilitating apparatus may further comprise a pressure meter operated according to pressure exerted from the pressuring holder to the pressurizing rod, the pressure meter being mounted on a portion moved together with the pressuring holder so as to recognize the amount of the pressure.

The waist strengthening and rehabilitating apparatus may further comprise a holding release unit for momentarily loosening the holding means, the holding release unit being mounted on the lower body holding means.

The waist strengthening and rehabilitating apparatus may further comprise a manual exercise lever for manually conducting exercise, the manual exercise lever being mounted on a frame moved together with the backrest or a portion of the load controller moved together with the backrest frame.

The waist strengthening and rehabilitating apparatus may further comprise a measuring instrument such as a load cell mounted on a frame moved together with the load controller to measure resisting force caused by exercise load, and a braking unit for the braking adjustment of the load controller and sectional braking mounted on the rotating shaft of the frame moved together with the load controller.

The waist strengthening and rehabilitating apparatus may further comprise a vertical rotating shaft, the vertical rotating shaft being situated under the support frame of the backrest to be operated in conjunction with the load controller, the vertical rotating shaft being aligned with the central line of the lumbar vertebrae so as to allow the waist to be twisted The present invention provides a waist strengthening and rehabilitating apparatus, in which a support unit is constructed by assembling all or some of a footrest, a backrest, a pedestal, a handle and related frames, and waist exercises are conducted utilizing a backrest frame operated in conjunction with a load controller with the lower part of his body being fixed to the support unit, the apparatus further comprising; lower body holding means for tightly holding the lower part of the body, the lower body holding means being mounted on the support unit; a pressure meter for recognizing the degree of the tightness of the lower body holding means, the pressure meter being mounted on a portion moved together with the lower body holding means; and a holding release unit for momentarily releasing the holding of the lower body holding means by the application of external manipulation, the holding release unit being mounted on a portion moved together with the lower body holding means.

The present invention provides a load controller, comprising: an annular space provided in a casing around its central shaft to accommodate with working fluid; a vane having the same shape as the cross section of the annular space positioned in the annular space to be operated in conjunction with the central shaft; an working fluid adjustor situated in a portion of the annular space to adjust the direction and amount of working fluid; and a fluid load adjustor formed to communicate with the annular space so as to adjust load by varying the volume of the inner cavity thereof; wherein the working fluid adjustor is comprised of a flow rate control valve and a flow direction control valve, and can adjust the direction and amount of working fluid.

The present invention provides a load controller, comprising: load applying means, in which a load lever is mounted to a portion moved together with a central shaft and the size of load can be adjusted by changing the position of weights; balancing means, in which an auxiliary load lever is situated to be opposite to the load lever and resisting force exerted from the outside to the central shaft is controlled by changing the position of weights; clutch means that is disposed between a portion moved together with a central shaft and the load applying means to connect or disconnect the load applying means with or from the apparatus; attenuating means that is mounted on the moved portion of the load applying means to attenuate return load generated by the load applying means while the load applying means is returned to its original position after performing movement; and sectional braking means, in which a ratchet gear portion is formed on a portion moved together with the central shaft and a stopper is situated in the vicinity of the ratchet gear portion, thereby performing sectional braking; wherein the load controller includes all or some of the load applying means, the balancing means, the clutch means, the attenuating means, and the sectional braking means.

BRIEF DESCRIPTION OF THE DRAWINGS

The above and other objects, features and other advantages of the present invention will be more clearly understood from the following detailed description taken in conjunction with the accompanying drawings, in which:

FIG. 18 is a horizontal cross section thereof, FIG. 19 is a vertical cross section thereof, and FIG. 20 is an enlarged view showing a principal portion of FIG. 18; FIG. 21 is a vertical cross section thereof, FIG. 22 is a vertical cross section showing the control connecting portion of FIG. 21 while control is connected to the apparatus, FIG. 23 is a vertical cross section showing the control connecting portion of FIG. 21 while control is disconnected from the apparatus, and FIG. 24 is a vertical cross section showing the lower portion of FIG. 21.

DESCRIPTION OF THE PREFERRED EMBODIMENTS

Figure 1:
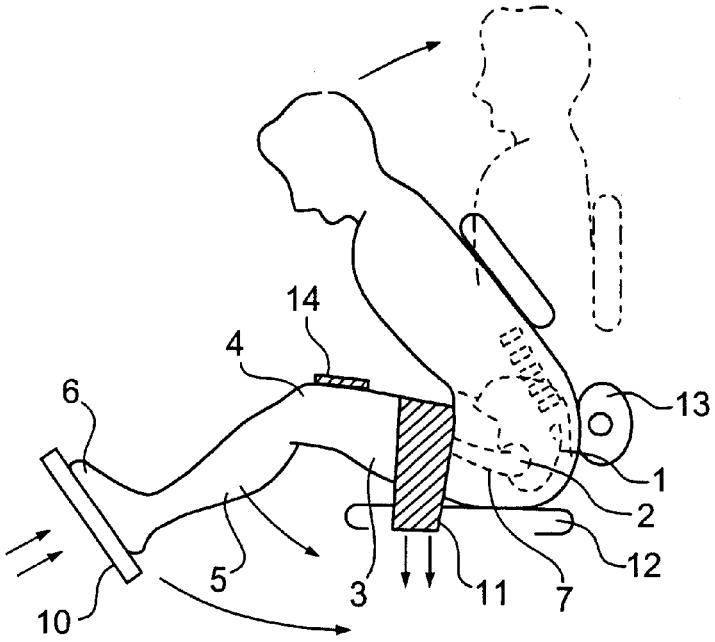
FIG. 1 PRIOR ART
FIG. 1 is a view showing a state in which the lower part of the body is held on a conventional waist strengthening and rehabilitating apparatus.

Embodiments of the present invention are described in detail with reference to accompanying drawings.

[First Embodiment]

A first embodiment of the present invention is described with reference to FIGS. 2 to 10, hereinafter.

A support unit 20 is constructed by assembling all or some of a footrest 15, a backrest 16, a pedestal 17, a handle 18 and related frames 8, 9 and 19. A user conducts waist movement utilizing the backrest frame 8 operated in conjunction with a load controller 80, with the lower part of his body being fixed to the support unit 20. Lower body holding means 30 is mounted on a support unit 20. The lower body holding means 30 is comprised of a front thigh holder 32 for tightly holding the front portion of the thigh and a rear thigh holder 34 for tightly holding the rear portion of the thigh.

The lower body holding means 30 may further include a pelvis holder 35. The pelvis holder 35 may be comprised of a front pelvis holder 36 for tightly holding the front portion of the pelvis and a rear pelvis holder 38 for tightly holding the rear portion of the pelvis.

Of course, as occasion arises, the lower body holding means 30 may include all or some of the front thigh holder 32, the rear thigh holder 34, the front pelvis holder 36 and the rear pelvis holder 38.

Additionally, the front thigh holder 32 and the rear thigh holder 34 may be each provided with an inclination support unit 40.

In this case, the front thigh holder 32 is comprised of moving means 300 in which a pressurizing bar 302 is guided by two pairs of moving links 304 supported by fixed frames 9, inclined link supporting means 320 provided with an elastic support 318 that supports one inclined moving link 304, stopper means 360 for preventing the moving link 304 from being moved rearward and allowing the moving link 304 to support the pressurizing bar 302, and pressurizing means 340 for allowing a pressurizing rod 308 to be pressurized by moving forward the moving link 304.

In the moving means 300, a pressurizing bar 302 is situated to slide while surrounding a hinge support member 310 to which the upper ends of the moving links 304 are hingedly attached, the adjusting knob 314 of the handle 312 and a plurality of through holes 316 are respectively formed on the upper surface of the pressurizing bar 302 and the hinge support member 310 to adjust the moving position of the pressurizing bar 302 by the insertion of the stopper 317 of the knob 314 into one through hole 316, and the pressurizing holder 306 is fixed in the cover 311 of the pressurizing rod 308 by means of a block 313 and fixing fins 315 to be movable.

The inclined link support means 320 is mounted to the support frame 9 of the support unit 20, and is constructed by attaching a roller member 324 to the upper end of the actuating rod 322 of an elastic support mechanism 318 that is shaped in the form of a spring shock absorber. The inclined link support means 320 serves to support the upper surface of the moving link 304 when the moving link 304 is advanced.

In the pressurizing means 340, a fixed block 332 is placed on a cross bar 330 fixedly disposed between the fixed frames 9. A threaded rod 338 is rotatably supported between the fixed block 332 and the connecting shaft 336 of a shaft support 334 fixedly mounted to one fixed frame 9. A moving piece 342 is fitted over the threaded rod 338 in a screw engagement manner to be hingedly connected to the lower ends of the rear pair of moving links 304. A connecting shaft 348, over which a pulley 346 is fitted, is disposed between the shaft support 334 and a bearing 344. Two splined portions 350' and 352' are formed on the inner portions of the connecting shafts 336 and 348. The handle shaft 352 of a handle 350 is fitted into the bearing 344 and the connecting shafts 336 and 348. A splined portion 354 is formed on the front end of the handle shaft 352. As the handle shaft 352 is moved forward or rearward, the threaded rod 338 is rotated by the connecting shaft 336 or the pulley 346 is rotated by the connecting rod 348 depending upon which one of the splined portions 350 and 352 the splined portion 354 of the handle shaft 352 is engaged with. As the threaded rod 338 is rotated, the pressurizing bar 302 is moved forward or rearward by the moving forward or rearward of the moving piece 332 and the moving links 304.

The stopper means 360 is constructed by hingedly attaching a ratchet gear member 364 to the fixed block 362 which is mounted on the cross member 330 and to which the lower ends of the moving links 304 are hingedly connected, and also hingedly attaching a stopper member 368 having a handle 366 to the center portion so that the projection 370 of the stopper member 368 is engaged with the gear 372 of the ratchet gear member 364, thereby preventing the moving links 304 from being moved rearward.

In this case, the front thigh holder 32 and the front pelvis holder 36 may be integrated into a pressurizing holder 306 so that the pressurizing holder 306 functions as both the front thigh holder 32 and the front pelvis holder 36.

In the inclination support unit 40, the pressurizing rod 308 to the lower surface of which the pressurizing holder 306 is attached is attached to the front portion of the pressurizing bar 302 by a hinge 402, a threaded rod 410 having an adjusting knob 408 at its one end is extended from a front fixed member 404 to a rear end member 406 through a hinge support member 310 and a protective pipe 407, a slide block 412 is fitted over the threaded rod 410 in a screw engagement manner in the vicinity of the fixing member 404, and an angle adjusting link 416 is arranged between the slide block 412 and the connecting link 414 of the pressurizing rod 308. When the threaded rod 410 is rotated by rotating the adjusting knob 408, the slide block 412 is moved forward or rearward and, accordingly, the angle adjusting link 416 is inclined at a different angle. The connecting link 414 hingedly connected to the angle adjusting link 416 is rotated around the hinge 402 at a different angle, along with the pressurizing rod 308, thereby bringing the inclined surface of the pressurizing holder 306 into contact with the body or taking away the inclined surface of the pressurizing holder 306 from the body.

The footrest 374 situated under the front thigh holder 32 is mounted to a moving block 376. The moving block 376 is moved along two guide rods 378 disposed between two opposing fixed frames 9. A threaded rod 380 is situated between the guide rods 378 to be rotated in the same position. A pulley 382 is fitted over one end of the threaded rod 380 and a belt 384 is wound around the pulleys 346 and 382, so that the pulleys 346 and 382 can be rotated together by the handle 350 and the handle shaft 352. Two links 390 are attached at their one-side ends to the fixed bracket 386 of the moving block 376 and a worm gear 388 mounted in the moving block 376*b*, and at their other-side ends to the footrest 374. The worm gear 388 is rotated by a worm 392 situated in the moving block 376 to adjust the position and mounting angle of the footrest 376. A spline portion is formed through the worm 392, the operating rod 394 having a spline portion is extended through the fixed frames 9 and inserted into the worm 392 in a spline engagement manner, and a handle 398 is attached to one end of the operating rod 394. As a result, the operating rod 394 is rotated by the rotation of the handle 398, the worm 392 and the worm gear 388 are rotated together with the operating rod 394, and, finally, the footrest 374 is operated by the movement of the link 390.

Figure 9:
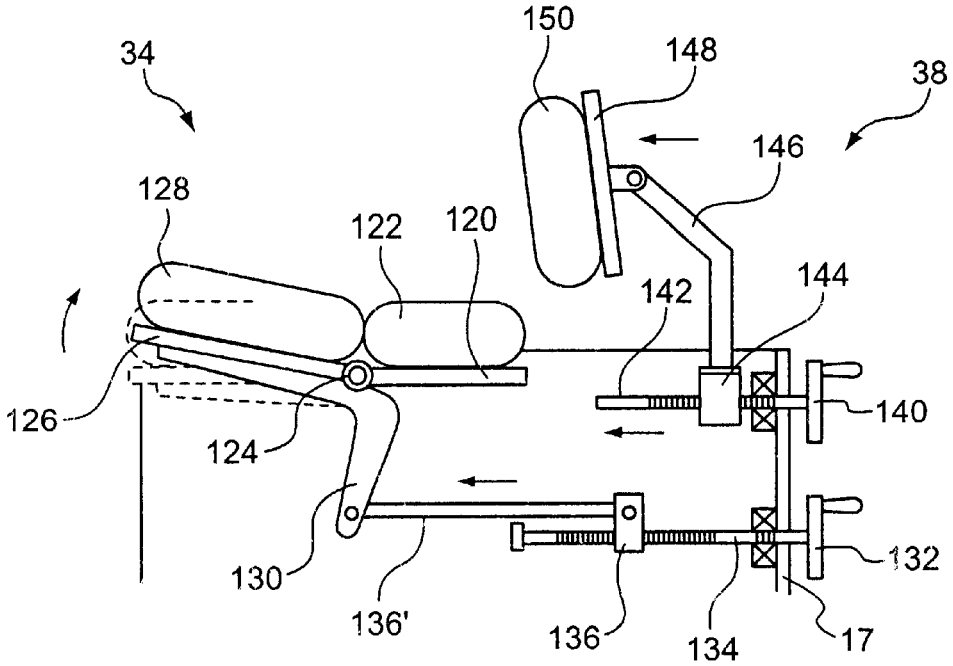
FIG. 9 is an enlarged side view showing the rear thigh holder and the rear pelvis holder of FIGS. 3 and 5.

As shown in FIG. 9, in the rear thigh holder 34, a fixed seat 122 is placed on a seat frame 120 and a moving seat 128 is placed on a moving frame 126 rotatably attached to the seat frame 120 by means of a hinge 124, a crank-shaped link 130 is attached to the lower surface of the moving frame 126, a moving piece 136 is engaged with a threaded rod 134 rotatably attached to the pedestal 17 and provided at its outer end with a handle 132, and the moving piece 136 and the link 132 are connected to each other by a connecting rod 136'. As a result, the threaded rod 134 is rotated by the rotation of the handle 132, the crank-shaped link 130 is moved through the connecting rod 136' by the rotational movement of the handle 132, and the moving seat 128 is moved upward or downward, thereby tightly pushing the rear part of the thigh.

Figure 10:
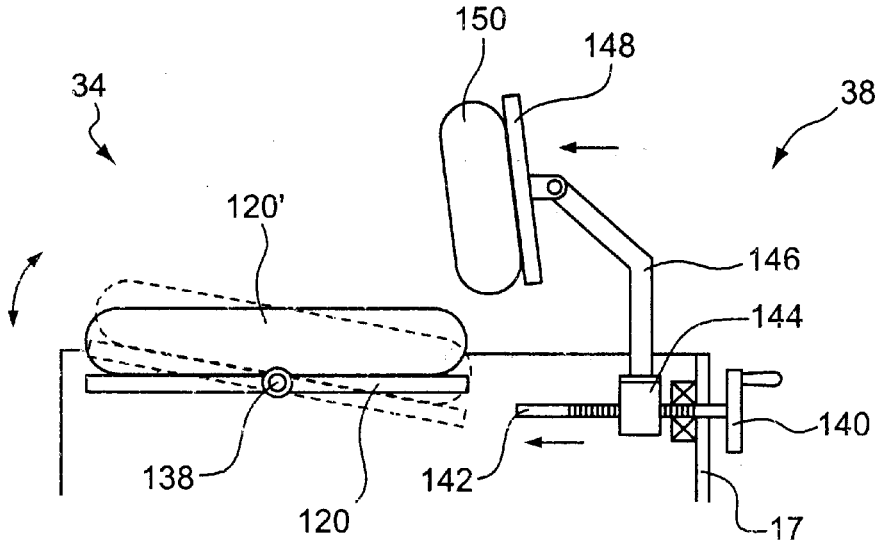
FIG. 10 is a side view showing the variation of FIG. 9.

Alternatively, in the rear thigh holder 34, a seat frame 120, as shown in FIG. 10, may be constructed to be rotated around a hinge 138 so that a single seat 120' can be brought into tight contact with the rear portion of the thigh.

As shown in FIGS. 9 and 10, in the rear pelvis holder 38, the moving piece 144 is engaged with the threaded rod 142 rotatably attached to the pedestal 17 and provided with a handle 140, an arm 146 is fixedly attached to the moving piece 144, a frame 148 is hingedly attached to the arm 146, and a pelvis rest 150 is attached to the frame 148. As a result, the moving piece 144 is moved forward or rearward by the rotation of the handle 140 and the arm 146, the frame 148 and the pelvis rest 150 are moved forward and rearward by the movement of the moving piece 144, thereby tightly pushing the rear part of the pelvis.

A pressure meter 42 operated in response to pressure exerted from the pressurizing holder 306 to the pressurizing rod 308 is mounted to a portion moved together with the pressurizing holder 306, so that the amount of pressure can be indicated by the pressure meter.

Figure 3:
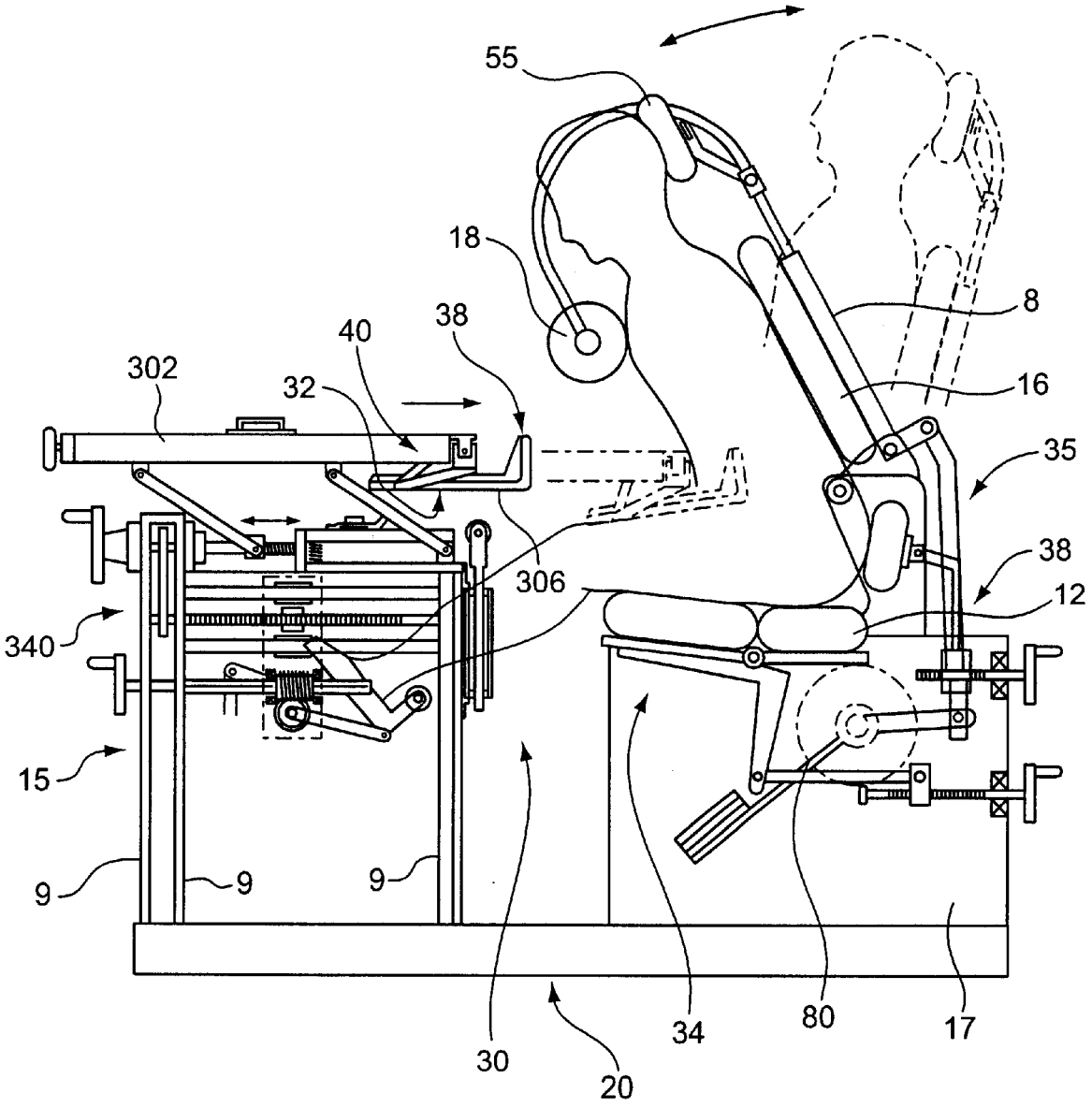
FIG. 3 is a schematic side view showing a waist strengthening and rehabilitating apparatus in accordance with a preferred embodiment of the present invention.
Figure 5:
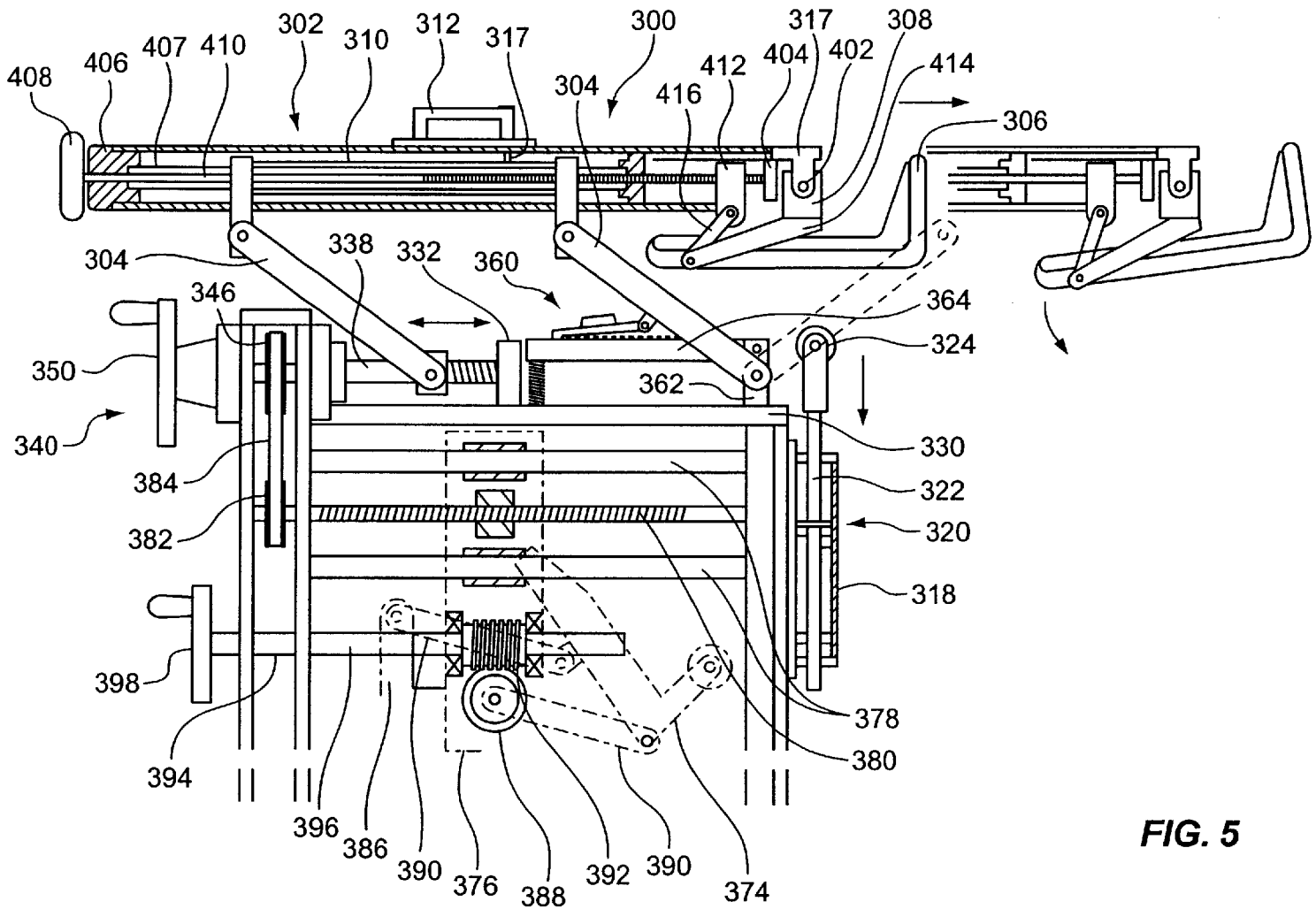
FIG. 5 is an enlarged partially sectional view showing a principal portion of FIG. 3.
Figure 6:
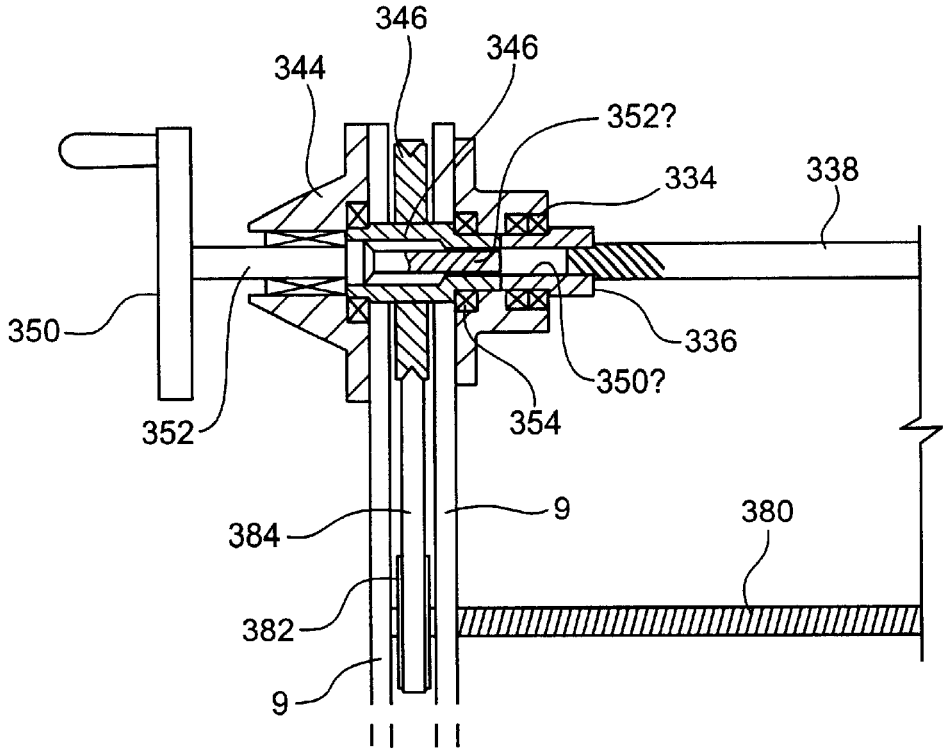
FIG. 6 is an enlarged view showing a principal portion of FIGS. 3 and 5.
Figure 7:
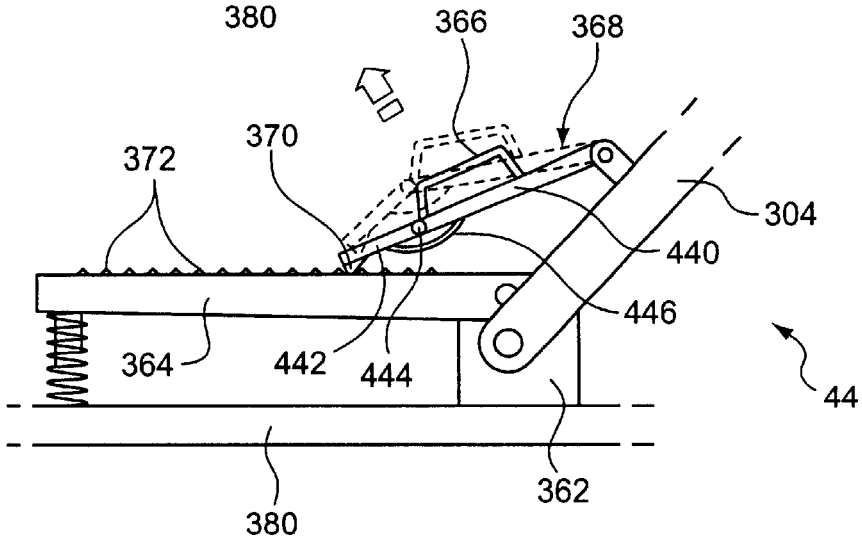
FIG. 7 is an enlarged view showing a principal portion of FIGS. 3 and 5.
Figure 8:
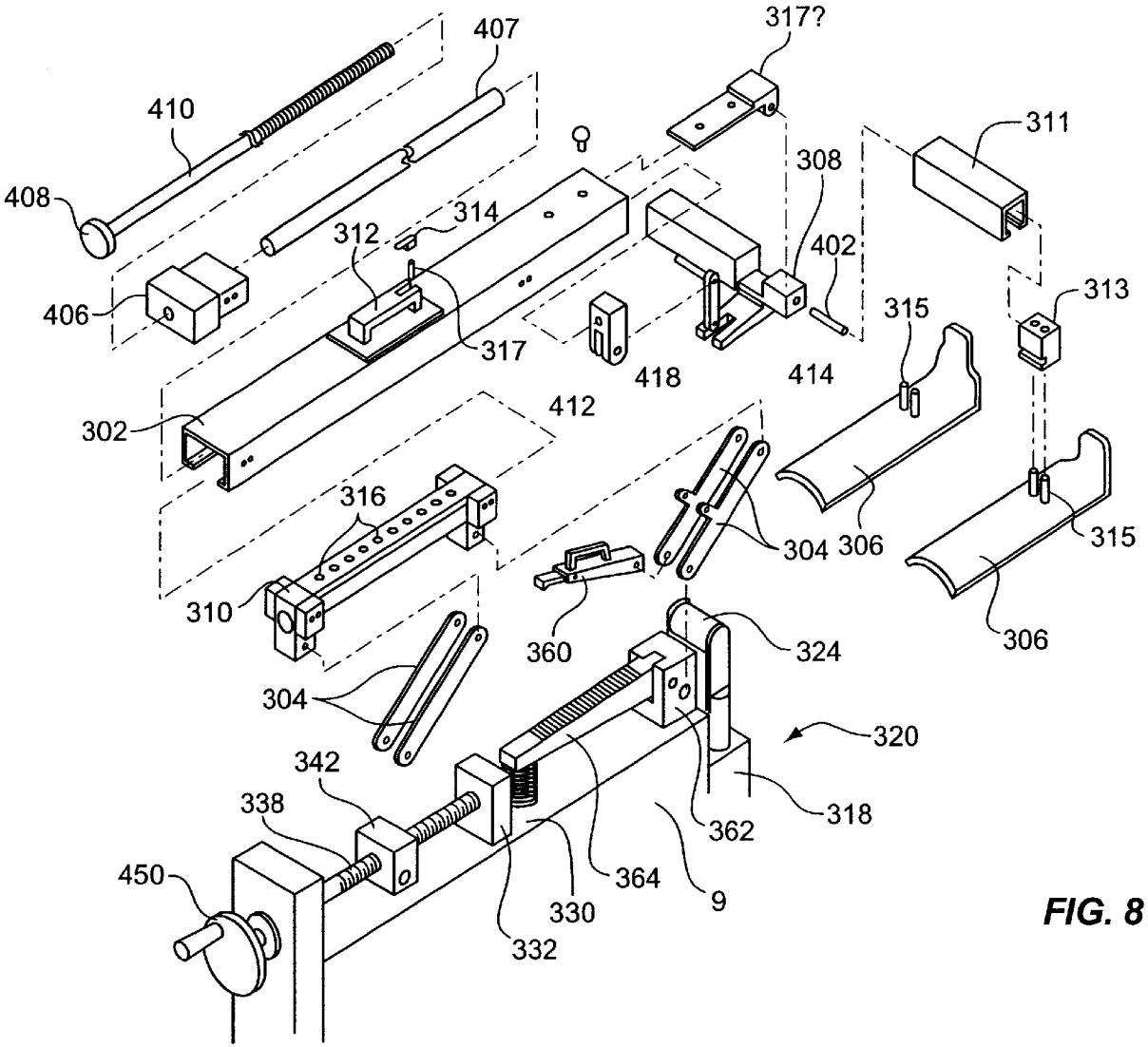
FIG. 8 is an exploded view showing the front thigh holder and front pelvis holder of FIGS. 3 and 5.

As illustrated in FIGS. 3, 5 and 7, for the portion moved together with the pressurizing holder 306, the pressure meter operated in response to pressure exerted from the pressurizing holder 306 to the ratchet gear member 364 through the pressurizing rod 308, the pressurizing bar 302, the moving links 304 and the stopper member 368 may be a spring type of meter. If necessary, one of other types of pressure meter can be utilized for the waist strengthening and rehabilitating apparatus.

The thigh or pelvis can be tightly held by the lower body holding means 30. A holding release unit 44 is mounted on the lower body holding means 30 to momentarily loosen the holding means 30, and can be mounted on the conventional exercise apparatus. As illustrated in FIGS. 3, 5 and 7, the holding release unit 44, a main rod 440 and a stopper rod 442 is connected to each other by a hinge 444, the extension of the main rod 440 covers the upper end portion of the stopper rod 442 to prevent the stopper rod 442 from being bent upward, and a plate spring 446 is attached to the lower portions of the main rod 440 and the stopper rod 442 to keep the main rod 440 and the stopper rod 442 extended. When the loosening of the pressurizing holder 306 is required for various reasons such as a severe pain while the thigh and the pelvis are tightly held by the pressurizing holder 306, the handle 370 is pulled so that the stopper rod 442 is rotated around the hinge 444 and raised upward. Accordingly, the moving link 304 grows to be freely movable without hindrance, and the pressurizing holder 306 can be loosened in an instant.

Figure 4:
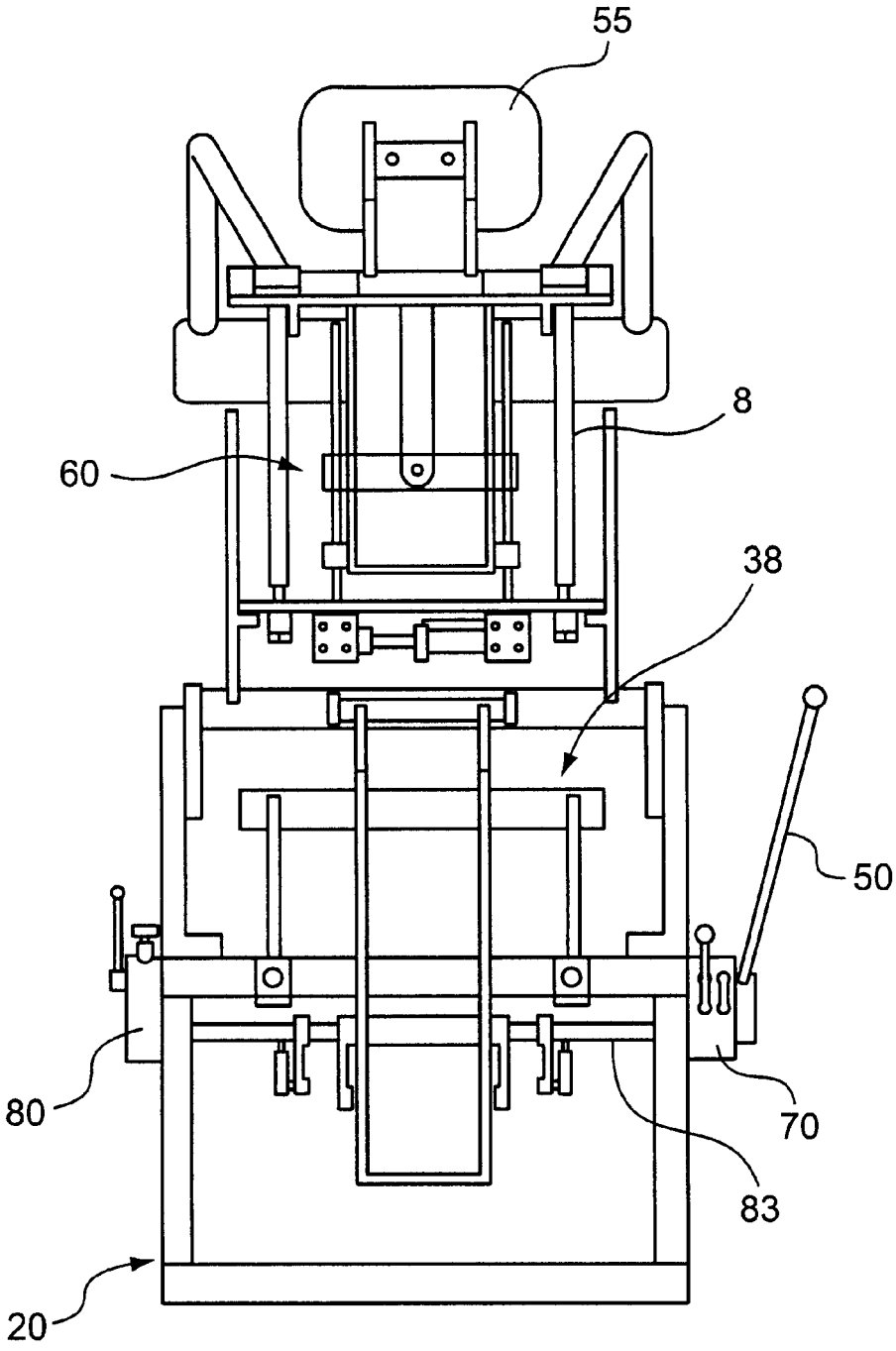
FIG. 4 is a schematic rear view of FIG. 3.

As shown in FIGS. 3 and 4, when the load controller 80 exerts load on the apparatus, a manual exercise lever 50 is mounted on a frame moved together with the backrest 16 or a portion of the load controller 80 moved together with the backrest frame 8 to allow manual exercise to be conducted.

As illustrated in FIG. 4, a measuring instrument 60 such as a load cell is installed on a frame moved together with the load controller 80 so as to measure resisting force according to exercise load. If necessary, exercise load can be measured by counterforce exerted on the frame regardless of loading or unloading state.

Figure 12:
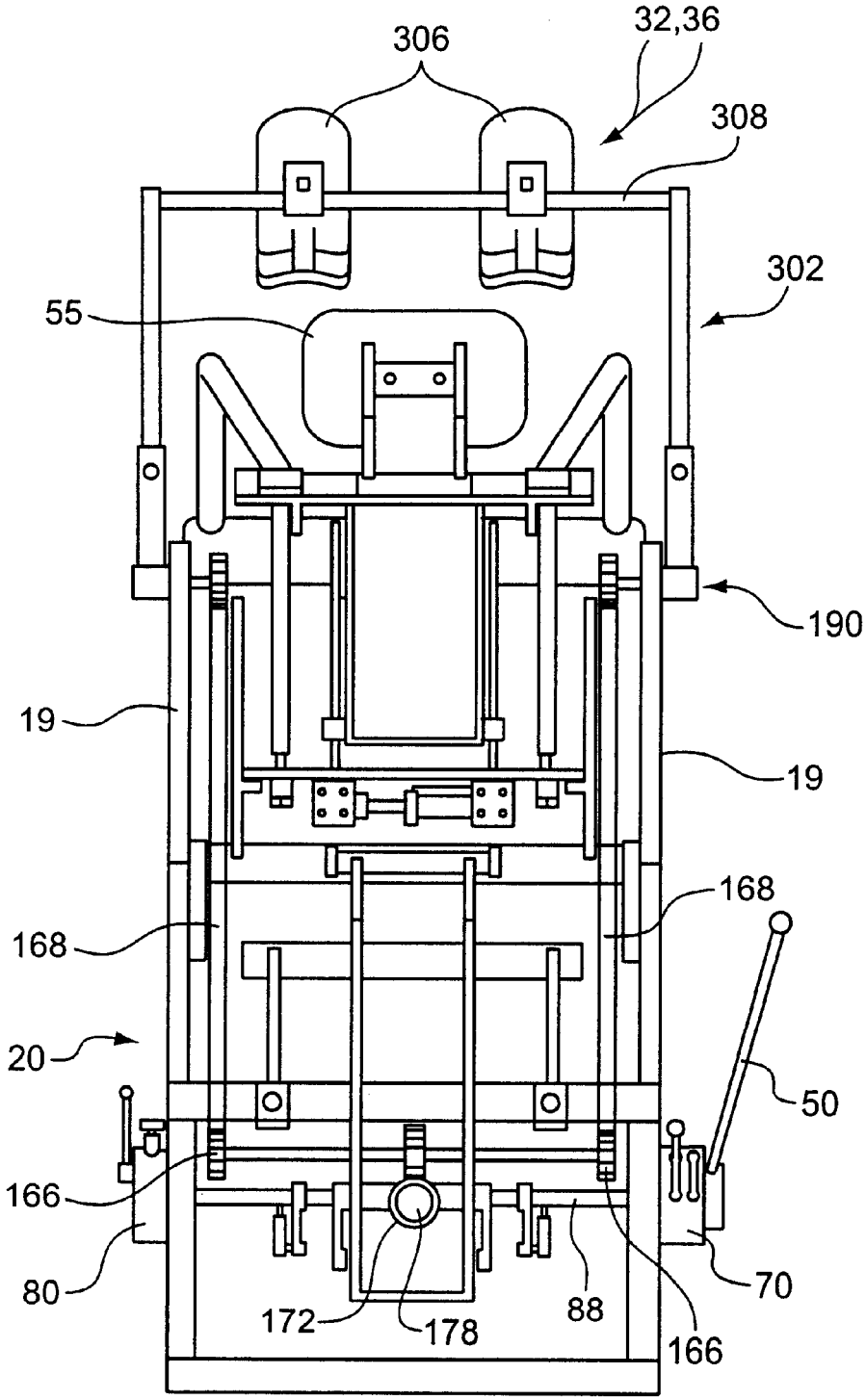
FIG. 12 is a schematic rear view of FIG. 11.
Figure 16:
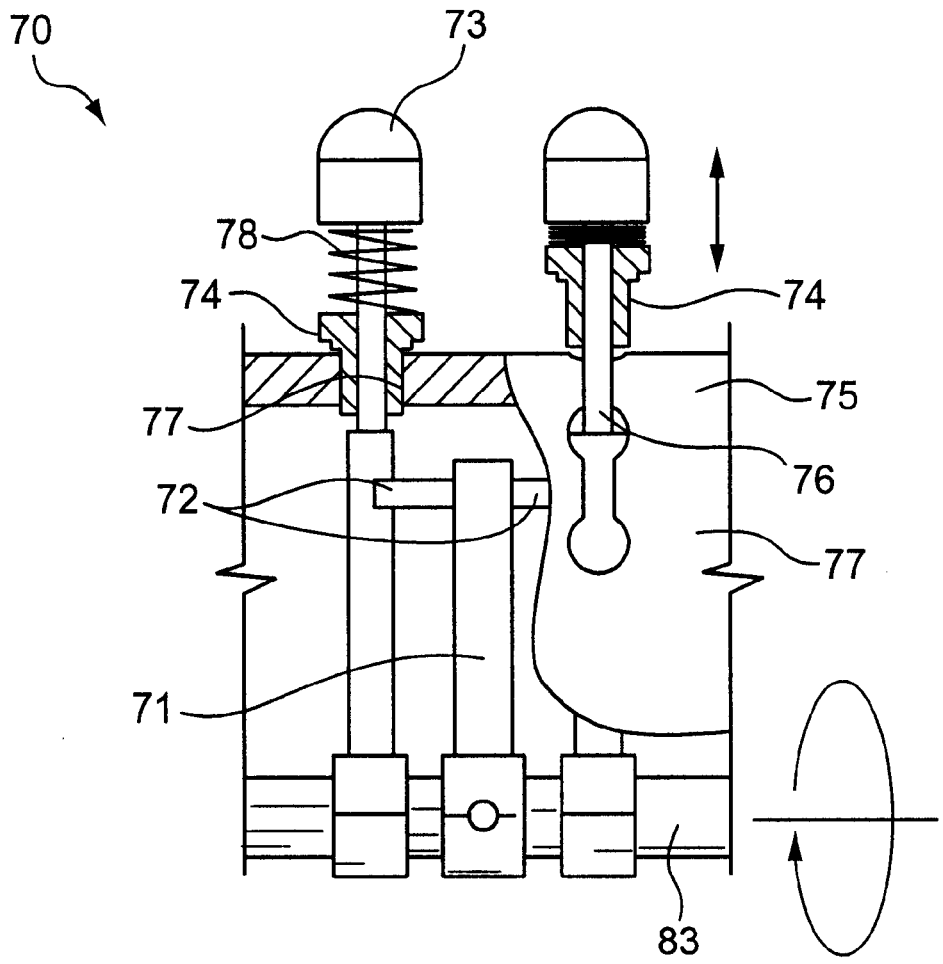
FIG. 16 is an enlarged partially sectional view showing the braking unit of FIGS. 4 and 12.

As depicted in FIGS. 4, 12 and 16, a braking unit 70 is mounted on a frame moved together with the load controller 80 to control the load of the load controller 80 by braking operation and to perform sectional braking. That is, the braking unit 70 serves to control exercise load and exercise range when exercise load is necessary or unnecessary. For example, the braking unit 70 may be mounted to a central shaft 83 that is the frame moved together with the load controller 80. With reference to FIGS. 3, 4 and 16, the braking unit 70 is comprised of a rotating disk 71 to which two stoppers 72 are attached, a pair of adjusting knobs 73 provided with two stoppers 74 and elastically supported by springs 78, two holes 76 for the adjustment of exercise range, two fixing cavities 77, and an outer casing 75 fixedly mounted on a support unit 20 to allow the adjusting knobs 73 to be exposed to the outside through the holes 77. As a result, when two movement ranges can be set by positioning the adjusting knobs 73 in the cavities 77 of the holes 76, the movement range of the rotating disk 71 moved together with the central shaft 82 is determined, thereby determining the movement range of the central shaft 83. When the adjusting knobs 73 are situated beside the stoppers 72, the movement range is not allowed the central shaft 83, thereby preventing the central shaft 83 from being rotated and causing the central shaft 83 to be held in place.

Reference numeral 55 designates a headrest.

[Second Embodiment]

Figure 11:
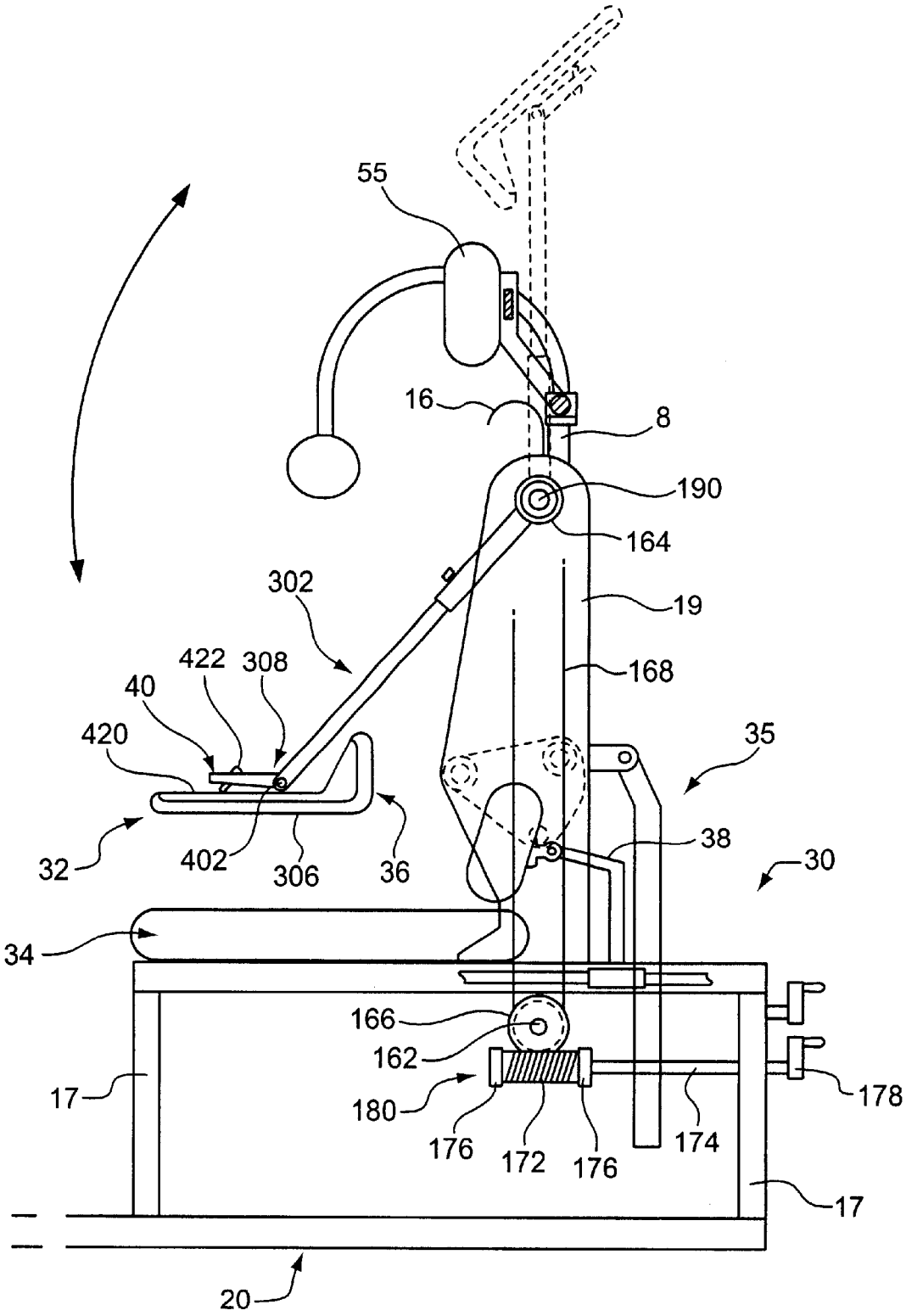
FIG. 11 is a side view showing a waist strengthening and rehabilitating apparatus and operation thereof in accordance with another embodiment of the present invention.

Next, with reference to FIGS. 11 and 12, a waist strengthening and rehabilitating apparatus in accordance with a second embodiment of the present invention is described.

Lower body holding means 30 is mounted on a support unit 20. The lower body holding means 30 is comprised of a front thigh holder 32 for tightly holding the front portion of the thigh and a rear thigh holder 34 for tightly holding the rear portion of the thigh. The lower body holding means 30 may further include a pelvis holder 35. The pelvis holder 35 may be comprised of a front pelvis holder 36 for tightly holding the front portion of the pelvis and a rear pelvis holder 38 for tightly holding the rear portion of the pelvis. Of course, as occasion arises, the lower body holding means 30 may be constructed by assembling all or some of the front thigh holder 32, the rear thigh holder 34, the front pelvis holder 36 and the rear pelvis holder 38.

Of the lower body holding means 30, the front thigh holder 32 is integrated with the front pelvis holder 36. This embodiment is different from the first embodiment in that a pressurizing rod 308 to which a pressurizing holder 306 is fixed is hingedly attached to the lower end of a retractable pressurizing bar 302 by means of a hinge 402 and the upper end of the pressurizing bar 302 is rotatably attached to a fixed frame 19 mounted on the support frame 20 by a shaft 190 so that the front parts of the thigh and the pelvis are tightly held by the rotation of the pressurizing bar 302 by means of external drive means 160.

In the external drive means 160, two sprocket wheels 164 and 166 are fitted over the shaft 190 of the pressurizing bar 302 and a lower shaft 162 rotatably situated in the vicinity of the pedestal 17, a chain 168 is situated to pass over the sprocket wheels 164 and 166, a worm gear is mounted to the lower shaft 162, a worm 172 engaged with the worm gear is mounted on the inner end of an actuating rod 174, the actuating rod 174 is rotatably fitted into two holding members 176, and a handle is fixedly attached to the outer end of the actuating rod 174. As a result, the actuating rod 174 is rotated by the handle 178, the worm 172 mounted on the end of the actuating rod 174 and the worm gear engaged with the worm 172 are rotated along with the actuating rod 174, the lower shaft 162 to which the worm gear mounted, the sprocket wheel 166, the chain 168 and the upper shaft 190 are moved, the pressurizing bar 302 attached to the upper shaft 190 is rotated, and, finally, the front parts of the thigh and the pelvis are tightly held by the pressurizing holder 306.

Since the rear thigh holder 34 has a general seat structure and the rear pelvis holder 38 has the same structure as that of the previous embodiment, the detailed description of these is omitted.

An inclination support unit 40 may be mounted to the front thigh holder 32. In the inclination support unit 40, a slippage preventing portion 420 is formed on the upper surface of the pressurizing holder 306, and a stopper member 422 is hingedly held over the front portion of the pressurizing holder 36. As a result, the stopper member 422 is brought into contact with the slippage preventing portion 420, and the contact position of the slippage preventing portion 420 and the stopper member 422 and the inclination of the pressurizing holder 306 are determined by the pushing or pulling of the stopper member 422.

In this embodiment, a manual exercise lever 50 is mounted to a portion of a frame operated in conjunction with a backrest 16 or a portion of a load controller 80 operated in conjunction with a backrest frame 8, thus allowing manual exercise to be conducted.

A braking unit 70 may be mounted on the central shaft 83 of the load controller 80 to control load exerted by the load controller 80 and perform sectional braking.

[Third Embodiment]

Figure 13:
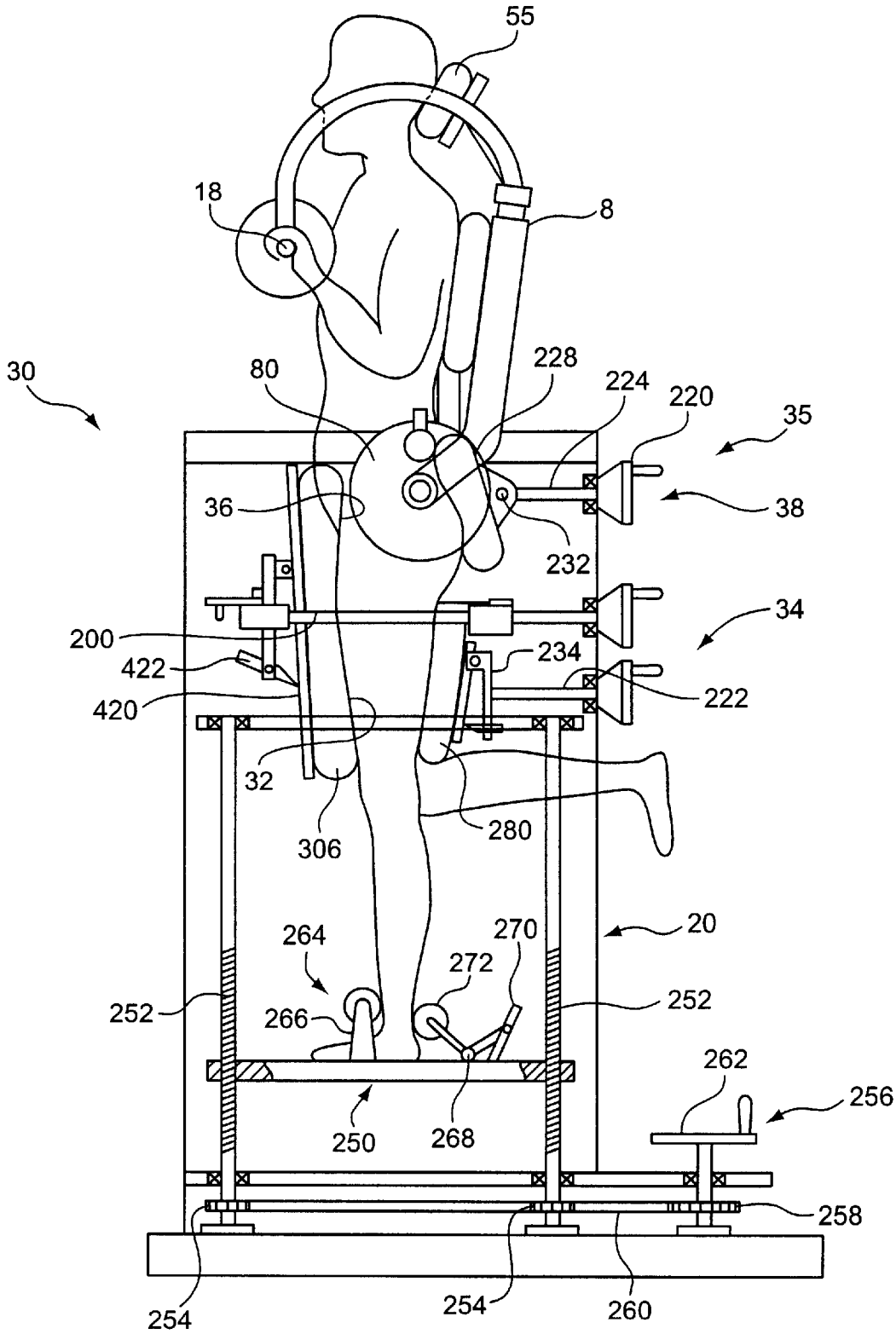
FIG. 13 is a side view showing a waist strengthening and rehabilitating apparatus and operation thereof in accordance with a further embodiment of the present invention.
Figure 14:
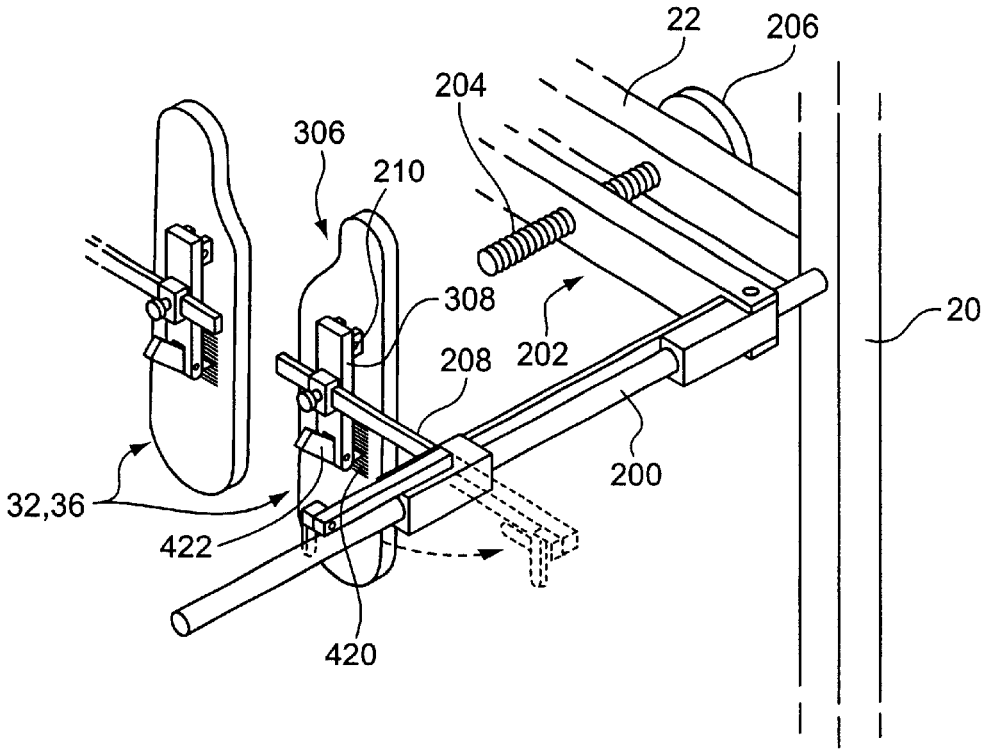
FIG. 14 is an enlarged schematic perspective view showing the front thigh holder and front pelvis holder of FIG. 13.
Figure 15:
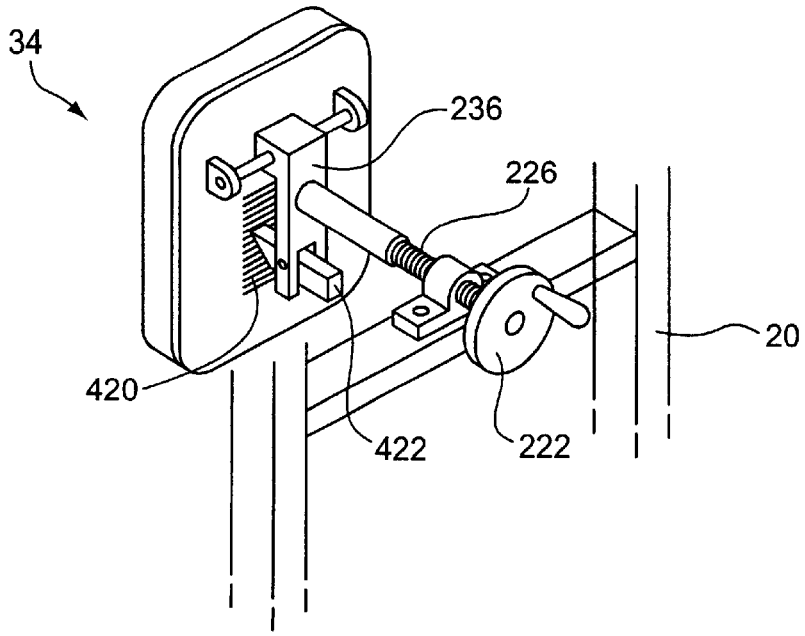
FIG. 15 is an enlarged schematic perspective view showing the rear thigh holder of FIG. 13.

Next, with reference to FIGS. 13 to 15, a waist strengthening and rehabilitating apparatus in accordance with a third embodiment of the present invention is described.

Lower body holding means 30 is mounted on a support unit 20. The lower body holding means 30 is comprised of a front thigh holder 32 for tightly holding the front portion of the thigh and a rear thigh holder 34 for tightly holding the rear portion of the thigh. The lower body holding means 30 may further include a pelvis holder 35. The pelvis holder 35 may be comprised of a front pelvis holder 36 for tightly holding the front portion of the pelvis and a rear pelvis holder 38 for tightly holding the rear portion of the pelvis. Of the lower body holding means 30, the front thigh holder 32 is integrated with the front pelvis holder 36.

In the front thigh holder 32 and the front pelvis holder 36, two guide rods 200 are each supported by two spaced support frames 20, a support bar 202 at its both ends fitted over the guide rods 200 is moved forward or rearward by a threaded rod 204 engaged with the support bar 202, the threaded rod 204 is inserted into a support frame 22 to be rotated at its original position and is provided with a handle 206, a pressurizing rod 308 is fitted over an arm 208 of the support rod 202, and a pressurizing holder 306 is attached to the pressurizing rod 308 by a hinge 210. As a result, the support bar 202 engaged with the threaded rod 204 is moved forward or rearward by the rotation of the handle 206, the arm 208 is moved forward or rearward, and the front portions of the thigh and the pelvis are tightly held by the movement of the pressurizing rod 308 and the pressurizing holder 306.

In the rear thigh holder 34 and the rear pelvis holder 38, a threaded rod 224 or 226 is mounted to the support frame 20 to be rotated at its original position, a handle 220 or 222 is attached to the outer end of the threaded rod 224 or 226, and a holder body 228 and 230 is attached to the inner end of the threaded rod 224 or 226 through a hinge 232 or 234. In particular, in the case of the rear thigh holder 34, the threaded rod 226 is attached to the holder body 230 through the support piece 236 and the hinge 234. As a result, the threaded rod 224 or 226 is rotated by the handle 220 or 222, and the rear portions of the thigh and the pelvis are tightly held by the movement of the holder body 228 and 230.

An inclination support unit 40 may be mounted to the front thigh holder 32, the front pelvis holder 36 and the rear thigh holder 34. In the inclination support unit 40, a slippage preventing portion 420 is formed on the upper surface of the pressurizing holder 306 or 203, and a stopper member 422 is hingedly held over the front portion of the pressurizing rod 308 or 236. As a result, when the lower end of the stopper member 422 is moved to a proper position on the slippage preventing portion 420, the stopper member 422 is brought into tight contact with the slippage preventing portion 420, thereby securely holding the inclined holder 32, 36 or 34.

A foothold 250 is engaged with two threaded rods 252 vertically situated to be rotated at their original positions in a thread, two sprocket wheels 254 are fitted over the lower portions of the threaded rods 252, the additional sprocket wheel 258 of a drive unit 256 is situated beside the two sprocket wheels 254, and a chain 260 is disposed to pass about the sprocket wheels 254 and 258. Accordingly, when the handle 262 of the drive unit 256 is rotated, the sprocket wheels 254 and 258 are simultaneously rotated in the same direction by the chain 260 and the threaded rods 252 are rotated by the rotation of the sprocket wheels 254 and 258, thus raising or lowering the foothold 250 to adjust the height of the foothold 250. A foot holder unit 264 is comprised of a front foot holder 266 fixed at a position and a rear foot holder 272 rotatably situated by a hinge 268 and provided with a rear stopper 270.

[Fourth Embodiment]

Figure 17:
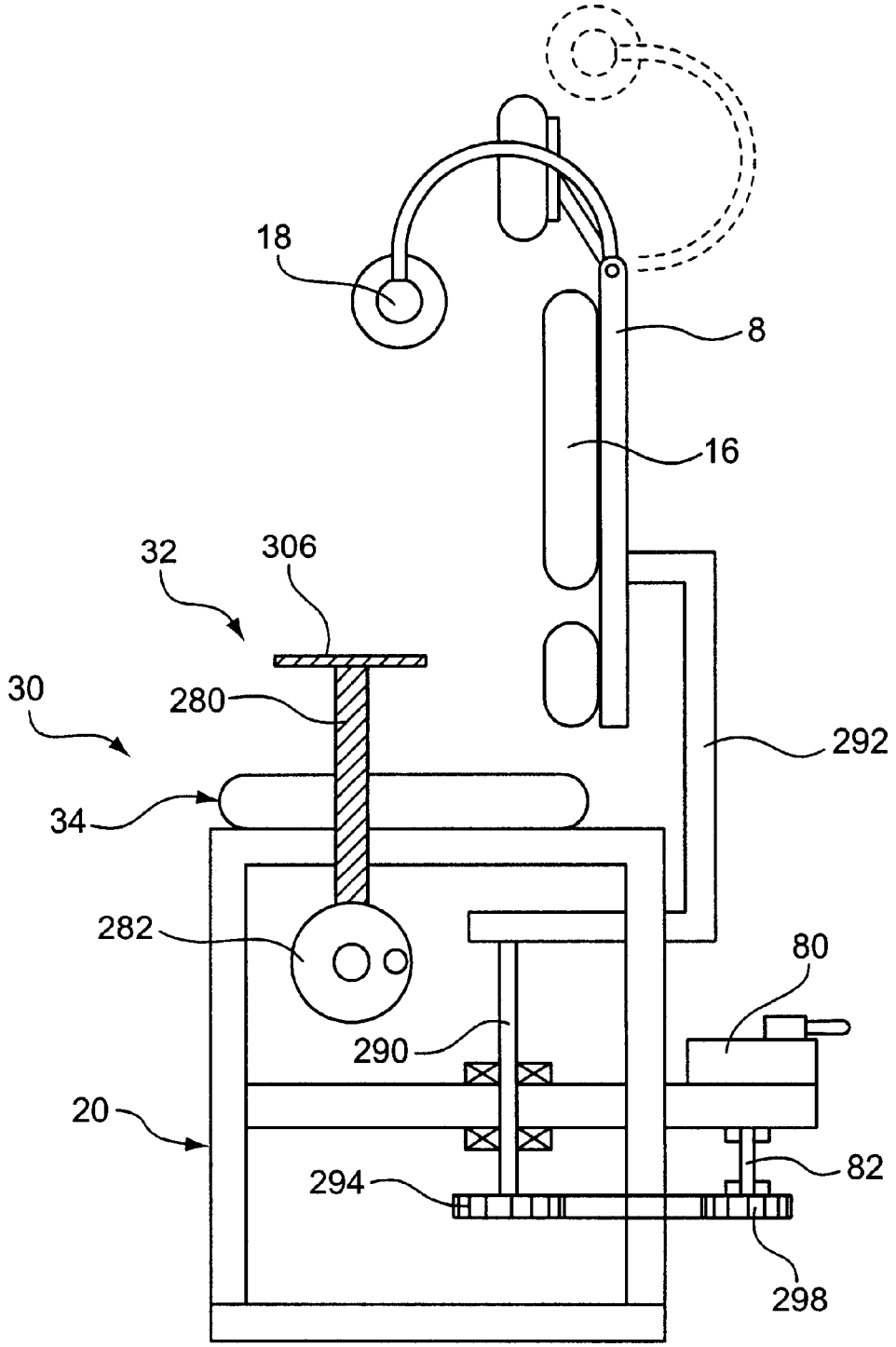
FIG. 17 is a side view showing a waist strengthening and rehabilitating apparatus and operation thereof in accordance with an additional embodiment of the present invention.

With reference to FIG. 17, a waist strengthening and rehabilitating apparatus in accordance with a fourth embodiment of the present invention is described.

Lower body holding means 30 is mounted on a support unit 20. The lower body holding means 30 is comprised of a front thigh holder 32 for tightly holding the front portion of the thigh and a rear thigh holder 34 for tightly holding the rear portion of the thigh. The front thigh holder 32 is provided with a belt 280 and a belt tightening handle 282 to tighten the front thigh holder 32, while the rear thigh holder 34 has a general seat plate structure.

This embodiment is characterized in that a vertical rotating shaft 290 situated under the backrest frame 8 of a backrest 16 is disposed to be rotated in conjunction with a load controller 80 and to be aligned with the central line of the lumbar vertebrae so as to allow the waist to be twisted. Additionally, a pulley 294 is fitted over the lower end of the vertical rotating shaft 290 connected to the backrest frame 8 through a connecting member 292, another pulley 296 is fitted over the lower end of the central shaft 82 of the load controller 80, and a belt is disposed to pass about the pulleys 294 and 296. As a result, the vertical rotating shaft 290 is in line with the central line of the lumbar vertebrae and is rotated in conjunction with the load controller 80, so that a user can conduct waist twisting exercises around the vertical rotating shaft 290 without hindrance while holding a handle 18.

[Fifth Embodiment]

Figure 18:
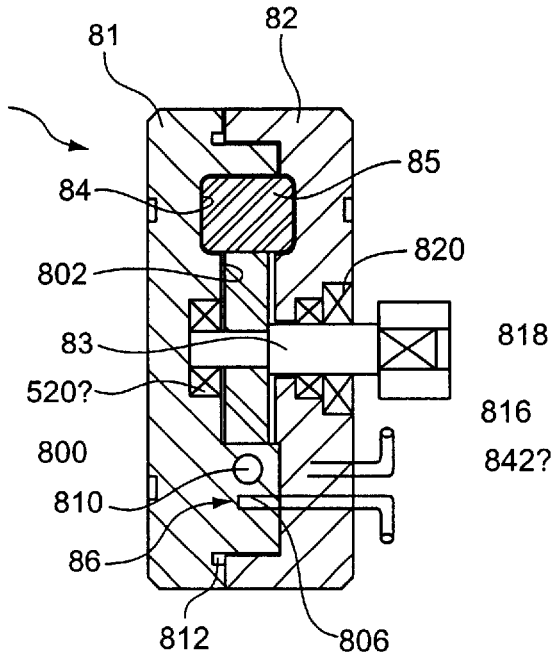
FIGS. 18 to 20 are views showing a load controller in accordance with a preferred embodiment of the present invention.
Figure 19:
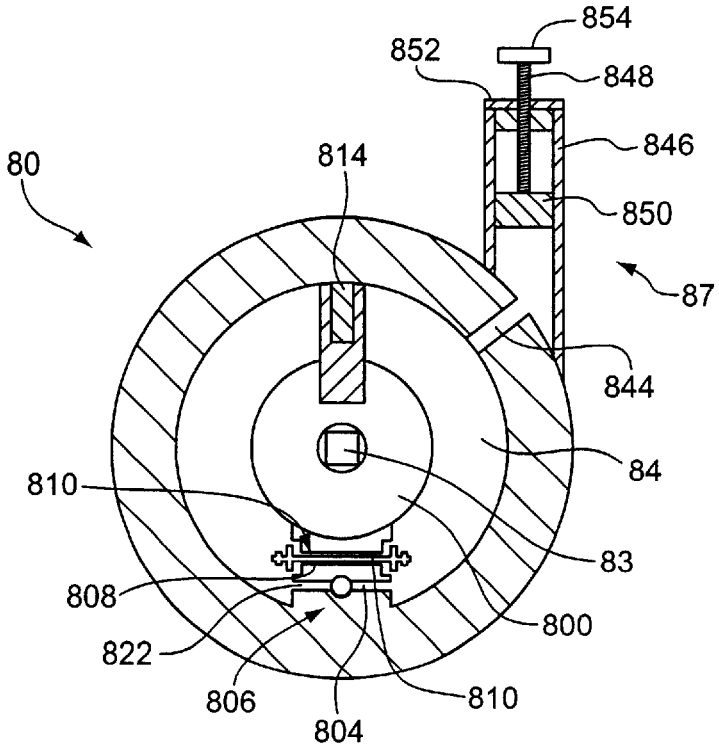
Figure 20:
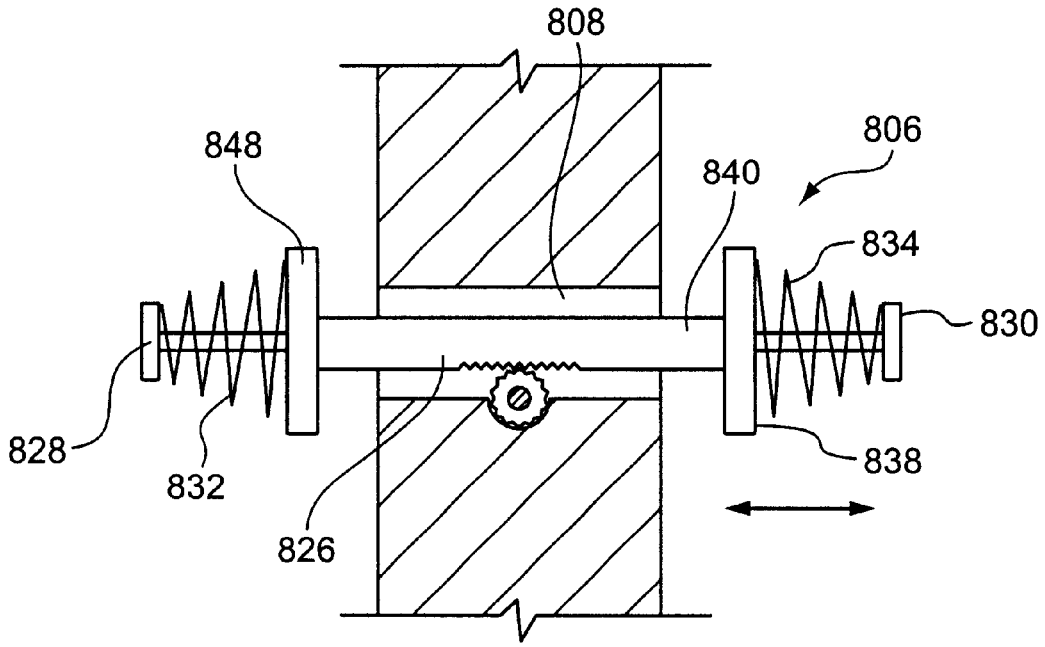
Figure 21:
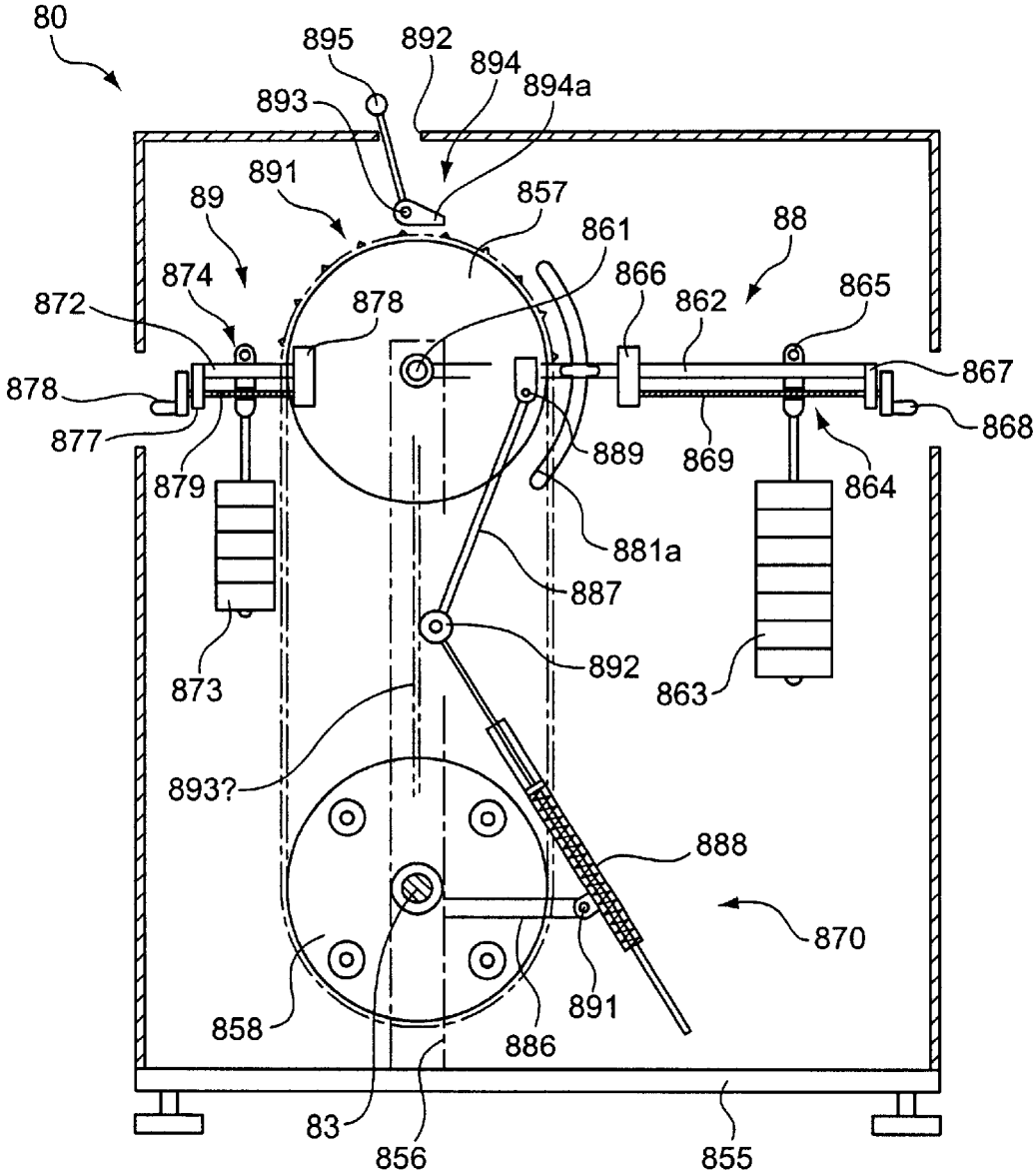
FIGS. 21 to 24 are views showing a load controller in accordance with another embodiment of the present invention.
Figure 22:
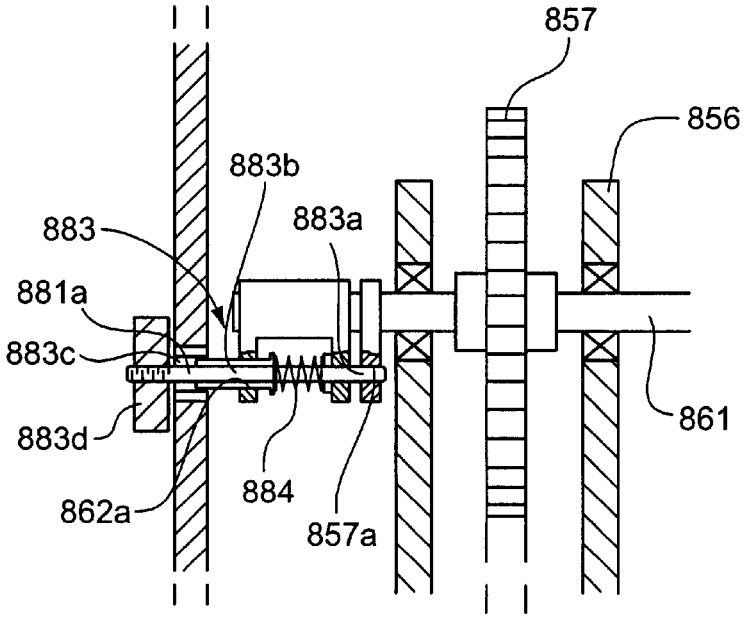
Figure 23:
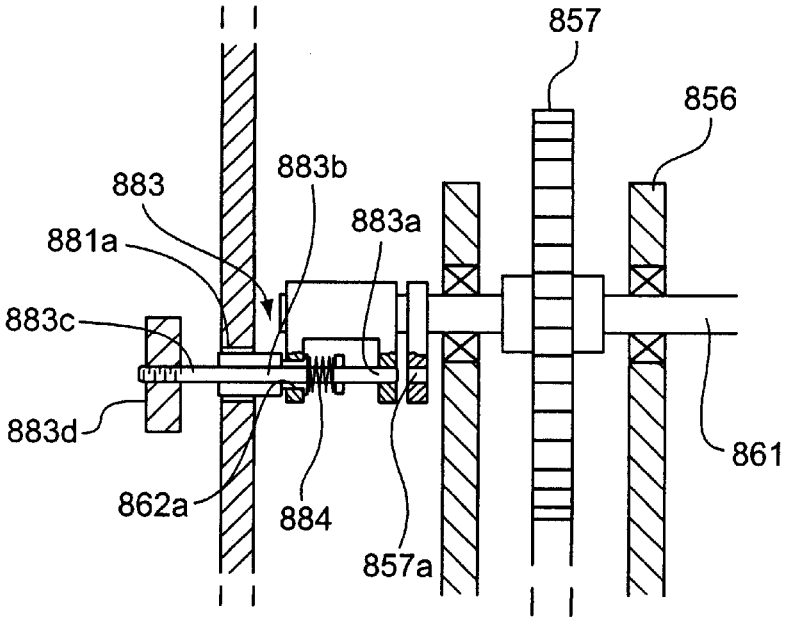
Figure 24:
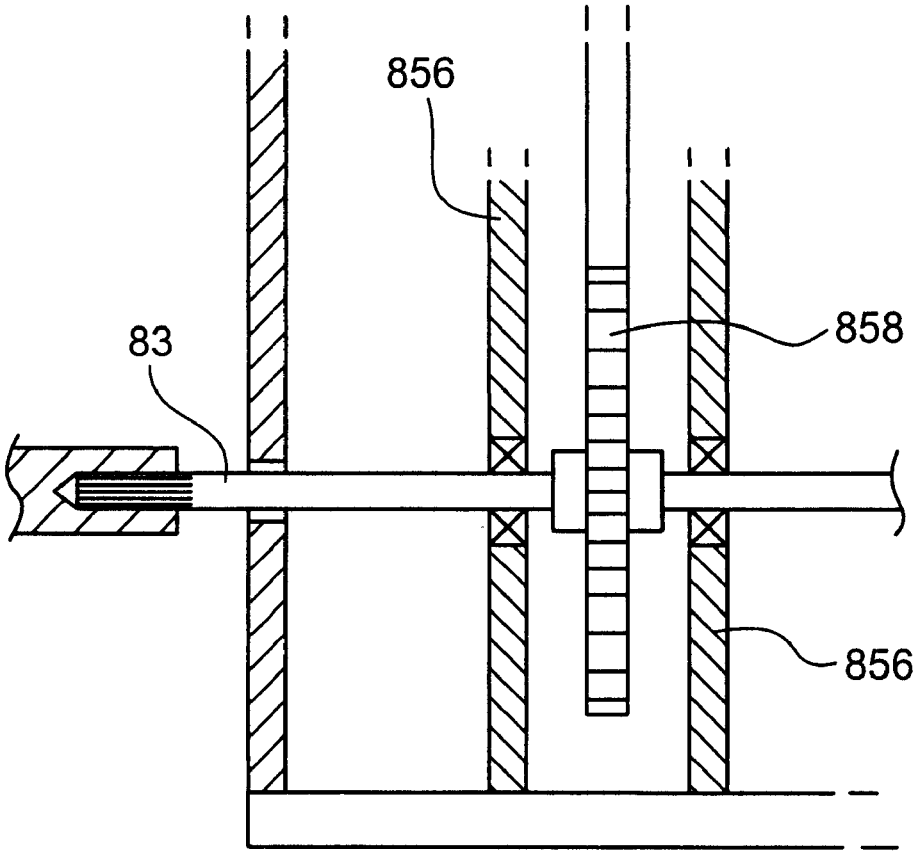

With reference to FIGS. 18 to 20, a load controller in accordance with a fifth embodiment of the present invention is described.

In the load controller 80, an annular space 84 is provided in a casing 81 and 82 around its central shaft 83 to accommodate working fluid, a vane 85 having the same shape as the cross section of the annular space 84 is positioned in the annular space 84 to be operated in conjunction with the central shaft 83, a working fluid adjustor 86 is situated in a portion of the annular space 84 to adjust the direction and amount of working fluid, and a fluid load adjustor 87 is formed to communicate with the annular space 84 so as to adjust load by varying an internal volume. The working fluid adjustor 86 is comprised of a flow rate control valve 806 and a flow direction control valve 810 and can adjust the direction and amount of working fluid.

In more detail, a circular mounting space 802 is provided for a holding member 800 in the annular space 84, the central shaft 83 is inserted at its lower end portion into the center of the casing 81 and 82, the holding member 800 is situated in the circular mounting space 802, the vane 85 is mounted to a portion of the holding member 800, and the working fluid adjustor 86 consisting of the flow rate control valve 806 and the flow direction control valve 810 is situated in fluid passages 804 and 808. The casing members 81 and 82 are engaged with each other in a screw engagement manner, sealing members 814 and 816 made of Teflon having a low frictional coefficient and a high abrasion resistance are applied to the vane 85 and the holding member 800, and a retainer 818 and an U-shaped packing 820 are situated around the central shaft 83.

In the flow rate control valve 806, a valve body 822 having a semicircular sectional shape is situated in the fluid passage 804. In the flow direction control valve 810, two valve bodies 836 and 838 elastically supported by two springs 832 and 834 situated on two valve seats 828 and 838 are situated at both ends of an operating shaft 826 on both sides of a fluid passage 808, and an operating piece 840 is positioned to move along the outside of the operating shaft 826. The operating piece 840 is moved in a rack-and-pinion manner to selectively open or close one of the valve bodies 836 and 838, thereby controlling the flow direction of the working fluid.

In the working fluid adjustor 87, an adjustor body 846 is mounted on a portion of the outer casing 81 and 82 to communicate with the annular space 84 through the fluid passage 844, and a piston 850 attached to a piston rod 848 is tightly fitted into the interior of the adjustor body 846. The size of the cavity of the adjustor body 846 is adjusted by the moving forward or rearward of the piston rod 848 and the piston 850 manipulated by the handle 854. As a result, the loading or unloading of the central shaft 83 generated by the operation of the vane 85 is effected depending on whether working fluid is accommodated in the annular space 84 or adjustor body 846.

The load controller 80 is used with the outer casing 81 and 82 secured to a stationary portion and the central shaft 83 mounted to the backrest frame 8 or other portions. When the central shaft 83 is rotated to operate the load controller 80, the vane 85 moved together with the holding member 800 is rotated in the annular space 84. The working fluid is adjusted in its exercise load, its applying direction and its loading or unloading by means of the flow rate control valve 806, the flow direction control valve 810 or the working fluid adjustor 87.

[Sixth Embodiment]

Hereinafter, with reference to FIGS. 21 to 24, a load controller utilizing weights in accordance with a sixth embodiment of the present invention is described.

The load controller 80 comprises load applying means 88, balancing means 89, clutch means 860, attenuating means 970, and a sectional braking means 880. In the load applying means 88, a load lever 862 is mounted to a portion moved together with a central shaft 83 and the size of load can be adjusted by changing the position of weights 863. In the balancing means 89, an auxiliary load lever 872 is situated to be opposite to the load lever 862 and resisting force exerted from the outside to the central shaft 83 is controlled by changing the position of weights 873. The clutch means 860 is disposed between a portion moved together with a central shaft 83 and the load applying means 88 to connect or disconnect the load applying means 88 with or from the apparatus. The attenuating means 870 is mounted on the moved portion of the load applying means 88 to attenuate return load generated by the load applying means 88 while the load applying means 88 is returned to its original position after performing movement. In the sectional braking means 880, a ratchet gear portion 891 is formed on a portion moved together with the central shaft 83 and a stopper 894 is situated in the vicinity of the ratchet gear portion 891, thereby performing sectional braking. The load controller 80 includes all or some of the load applying means 88, the balancing means 89, the clutch means 860, the attenuating means 970, and the sectional braking means 880.

In more detail, in the load applying means 88, upper and lower sprocket wheels 857 and 858 are rotatably attached to the upper and lower portions of fixed posts 856 fixed to a base 855, the central shaft 83 is fitted into the lower sprocket wheel 858 in a spline engagement manner, a chain 859 is disposed to pass about the sprocket wheels 857 and 858, the load lever 862 is attached to the central shaft 861 of the sprocket wheel 857 or the sprocket wheel 857, weights 863 are mounted to one end of the load lever 862, and a roll 865 is attached to the upper surface of the moving piece 864 on which weights 865 rest so as to allow the moving piece 864 to be moved along the upper surface of the load lever 862. Additionally, a threaded rod 869 provided with a handle 868 is rotatably supported by two spaced and fixed blocks 866 and 867 and inserted into the moving piece 864 in a screw engagement manner. Accordingly, the moving piece 864 is moved forward or rearward by the rotation of the threaded rod 869 by means of the handle 868 and the position of the weights 863 is changed, thus adjusting the size of exercise load.

In the balancing means 89, the auxiliary load lever 872 is mounted to the sprocket wheel 857 to be opposite to the load lever 862 and the weights 873 hang on a portion of the auxiliary load lever 872. The weights 873 are disposed to adjust attenuation force by the change of their position while a threaded rod 879 is rotated by the rotation of a handle 878. As shown in FIGS. 4, 12, 13 and 14, in this case, resistant force exerted on the central shaft 83 corresponds to exercise resistant force required for the movement of the backrest frame or other parts that should be moved in conjunction with the central shaft 83 when the load controller is employed for the waist strengthening and rehabilitating apparatus.

The clutch means 860 serves to selectively utilize and intercept exercise load generated by the load applying means 88. In the clutch means 860, a through hole 857*a*, a longitudinal hole 862*a* and an arc hole 881*a* are formed at positions between a portion operated in conjunction with the central shaft 83 and the load applying means 88, for example, a portion operated in conjunction with the upper sprocket 857, a side of the load lever 862 and a corresponding portion of the outer casing 881, and an adjusting knob 883 is elastically supported on the inside of the outer casing 881 by a spring 884 with its grip exposed to the outside. The adjusting knob 883 is comprised of a first projection portion 883*a* provided at its front end and inserted into the through hole 857*a*, a second projection portion 883*b* elliptically sectional-shaped and inserted into the longitudinal hole 862*a*, a third projection portion 883*c* inserted into the arc hole 881*a*, and the handle 883*b*. Accordingly, when the first projection portion 883*a* and the second projection portion 883*b* are respectively inserted into the through hole 857*a* and the longitudinal hole 862*a*, the sprocket wheel 857 is connected to the load lever 862 by an adjusting knob 883, thereby allowing the load applying means 88 to be operated in conjunction with the load applying means 88. On the other hand, when the adjusting knob 883 is pulled out and rotated, the first projection portion 883*a* and the second projection portion 883*b* are respectively taken out from the through hole 857*a* and the longitudinal hole 862*a* and the sprocket wheel 857 is disconnected from the load lever 862, thereby allowing the apparatus to be operated separately from the load applying means 88 and, accordingly, allowing manual exercise to be conducted.

In the attenuating means 870, a connecting link 887 and an attenuator 888 are arranged between a portion of the load lever 862 and a fixed bracket 886 secured to the fixed posts 856 using hinges 889 and 891 and a slide roll 892. In this case, the slide roll 892 is situated to be brought into contact with a slide plate 893 positioned between the fixed posts 856 and to slide on the slide plate 893. While the load applying means 88 is returned to its original position after conducting one-directional exercise movement, return load produced by the load applying means 88 is attenuated by the cooperation of the connecting link 887, the slide roll 892 and the attenuator 888.

In the sectional braking means 880, the ratchet gear portion 891 is formed on a side of the sprocket wheel 857 moved in conjunction with the central shaft 83, an opening 982 is formed in an outer casing 881 to face the ratchet gear portion 891, and the stopper 894 is rotatably attached by a hinge 893 to expose its handle 895 to the outside. Accordingly, the front end of the stopper 894 is engaged with the ratchet gear portion 891 at a position that is determined by the manipulation of the handle 895.

Accordingly, the central shaft 83 is fitted into the lower sprocket wheel 858 in a spline engagement manner, so that the load controller 80 can be utilized in conjunction with or separately from the load applying means 88.

Figure 2:
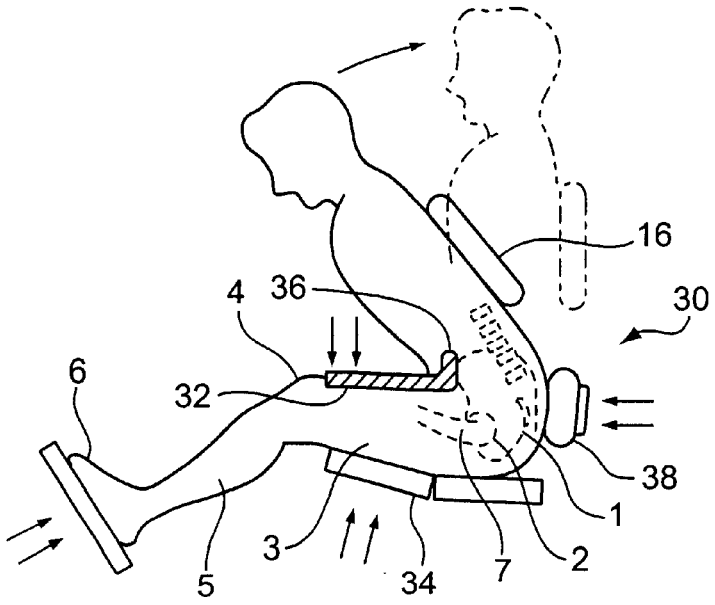
FIG. 2 is a view showing a state in which the lower part of the body is held on a waist strengthening and rehabilitating apparatus in accordance with the present invention.

The lower body holding means 30 includes all or some of the front thigh holder 32, the rear thigh holder 34, the front pelvis holder 36 and the rear pelvis holder 38, so that the lower part of the body including the pelvis can be securely held by the holders. In particular, as shown in FIG. 2, the lower body holding means 30 includes the front thigh holder 32, the rear thigh holder 34, the front pelvis holder 36 and the rear pelvis holder 38, and can hold the thigh and the pelvis including the femur 7, the hip bones 1 and the hip joints 2, thereby securely holding the thigh and the pelvis during exercise.

Consequently, as shown in FIGS. 3, 4, 10, 11, 12 and 16, when a user conducts bending, reflexion and twisting exercises while sitting down or standing up, the strengthening and rehabilitating of the waist can be carried out while the lower part of the body is secured and stably held by the holders.

In addition, the lower part of the body is securely and stably held by employing the pressure meter 42 and the pressure release unit 44. The mode of exercise can be adjusted by employing the manual exercise lever 50 and the braking unit 70.

As described above, the present invention provides a waist strengthening and rehabilitating apparatus, which is capable of sufficiently securing the lower part of the body, including the pelvis, by means of lower body holding means, momentarily loosening the lower part in an emergency and preventing accidents that may occur during excise.

The waist strengthening and rehabilitating apparatus of the present invention is provided with the manual exercise lever 50 and the braking unit 70, so that the apparatus allows waist strengthening and rehabilitating exercise to be actively or passively conducted within a predetermined angle and allows a user to conduct extension, reflexion and twisting exercises.

The load controller of the present invention can easily adjust the quantity and direction of load required for strengthening and rehabilitating exercises, has a simple structure, is capable of being widely used in places requiring load, and is easily installed and utilized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A waist strengthening and rehabilitating apparatus, in which a support unit is constructed by assembling all or some of a footrest, a backrest, a pedestal, a handle, and related frames, and waist exercises are conducted utilizing a backrest frame operated in conjuction with a load controller with the lower part of a user's body being fixed to the support unit, said apparatus further including a lower body holder for tightly holding the front portion of a thigh and a rear thigh holder for tightly holding the rear potion of the thigh, wherein said lower body holder further comprises:

a pelvis holder, said pelvis holder comprising a front pelvis holder for tightly holding the front portion of a pelvis and a rear pelvis holder for tightly holding the rear portion of the pelvis.

2. A waist strengthening and rehabilitating apparatus, in which a support unit is constructed by assembling all or some of a footrest, a backrest, a pedestal, a handle, and related frames, and waist exercises are conducted utilizing a backrest frame operated in conjunction with a load controller with the lower part of a user's body being fixed to the support unit, said apparatus further including a lower body holder mounted on said support unit, said lower body holder having a front thigh holder for tightly holding the front portion of a thigh and a rear thigh holder for tightly holding the rear portion of a thigh, wherein said lower body holder further comprises:

one or both of a front pelvis holder and a rear pelvis holder.

3. A waist strengthening and rehabilitating apparatus, in which a support unit is constructed by assembling all or some of a footrest, a backrest, a pedestal, a handle, and related frames, and waist exercises are conducted utilizing a backrest frame operated in conjunction with a load controller with the lower part of a user's body being fixed to the support unit, said apparatus further including a lower body holder mounted on said support unit, said lower body holder having a front thigh holder for tightly holding the front portion of a thigh and a rear thigh holder for tightly holding the rear portion of a thigh, further comprising a holding release unit for momentarily loosening said lower body holder, said holding release unit being mounted on said lower body holder.

4. A waist strengthening and rehabilitating apparatus, in which a support unit is constructed by assembling all or some of a footrest, a backrest, a pedestal, a handle, and related frames, and waist exercises are conducted utilizing a backrest frame operated in conjunction with a load controller with the lower part of a user's body being fixed to the support unit, said apparatus further including a lower body holder mounted on said support unit, said lower body holder having a front thigh holder for tightly holding the front portion of a thigh and a rear thigh holder for tightly holding the rear portion of a thigh, further comprising a manual exercise lever for manually conducting exercise, said manual exercise lever being mounted on a frame moved together with said backrest or a portion of said load controller moved together with said backrest frame.

5. A waist strengthening and rehabilitating apparatus, in which a support unit is constructed by assembling all or some of a footrest, a backrest, a pedestal, a handle, and related frames, and waist exercises are conducted utilizing a backrest frame operated in conjunction with a load controller with the lower part of a user's body being fixed to the support unit, said apparatus further including a lower body holder mounted on said support unit, said lower body holder having a front thigh holder for tightly holding the front portion of a thigh and a rear thigh holder for tightly holding the rear portion of a thigh, further comprising a measuring instrument such as a load cell mounted on a frame moved together with said load controller to measure resisting force caused by exercise load, and a braking unit for the braking adjustment of said load controller and sectional braking mounted on a rotating shaft of the frame moved together with said load controller.

6. A waist strengthening and rehabilitating apparatus, in which a support unit is constructed by assembling all or some of a footrest, a backrest, a pedestal, a handle and related frames, and waist exercises are conducted utilizing a backrest frame operated in conjunction with a load controller with the lower part of his body being fixed to the support unit, said apparatus further comprising:

a lower body holder tightly holding the lower part of the body, said lower body holder being mounted on said support unit;

a pressure meter for recognizing the degree of the tightness of said lower body holder, said pressure meter being mounted on a portion moved together with said lower body holder; and a holding release unit for momentarily releasing the holding of said lower body holder by the application of external manipulation, said holding release unit being mounted on a portion moved together with said lower body holder.

* * * * *